US006085826A

United States Patent [19]

Maesaki

[11] Patent Number: 6,085,826

[45] Date of Patent: Jul. 11, 2000

[54] RUNNER WITH LINE TENSIONING CAPABILITIES, GUIDE RAILS FOR ELECTRICALLY-OPENED AND CLOSED CURTAINS, AND GUIDE RAILS FOR MANUALLY-OPENED AND CLOSED CURTAINS

[75] Inventor: Shu Maesaki, Higashiosaka, Japan

[73] Assignee: Navio, Inc., Osaka, Japan

[21] Appl. No.: 09/080,825

[22] Filed: May 18, 1998

[30] Foreign Application Priority Data

Jan. 27, 1998 [JP] Japan ..... 10-014684
Apr. 23, 1998 [JP] Japan ..... 10-113972

[51] Int. Cl.[7] ..... A47H 5/00

[52] U.S. Cl. ..... 160/345; 160/331; 16/93 D

[58] Field of Search ..... 160/330, 331, 160/344, 124, 345, 346, 347; 16/93 D, 87.2, 87.4 R, 93 R

[56] References Cited

U.S. PATENT DOCUMENTS 2,761,499 9/1956 Ohlander ..... 16/93 D
3,502,132 3/1970 Hager et al. ..... 160/331
3,665,550 5/1972 Macfarlane et al. ..... 16/93 D
4,306,332 12/1981 Simmons .
5,381,846 1/1995 Lichy ..... 160/273.1

FOREIGN PATENT DOCUMENTS 2645402 4/1978 Germany ..... 160/331
6-42540 11/1994 Japan .
7-37570 8/1995 Japan .

*Primary Examiner*—Blair M. Johnson
*Attorney, Agent, or Firm*—Darby & Darby

[57] ABSTRACT

A runner and guide rail for curtains intended to maintain a line for opening and closing the curtains automatically and constantly to the tension state by intermediately installing elastic members at the connections between the runner and the line. A guide rail for curtains that can be compactly stored and transported by dividing the guide rail body and linking segments with bendable couplers. In addition, a guide rail for manually opened and closed type curtains which can simultaneously open and close right and left curtains by pulling the curtain on one side.

14 Claims, 23 Drawing Sheets

RUNNER WITH LINE TENSIONING CAPABILITIES, GUIDE RAILS FOR ELECTRICALLY-OPENED AND CLOSED CURTAINS, AND GUIDE RAILS FOR MANUALLY-OPENED AND CLOSED CURTAINS

BACKGROUND OF THE INVENTION

The present invention relates to a runner with line tensioning capabilities for linking to a line installed movably to a guide rail used for opening and closing electrically-opened and closed type curtains, etc., holding curtains to the guide rail, and arranged along the guide rail in a form of a loop and a guide rail for curtains using the runner. The present invention also relates to a guide rail for electrically-opened and closed type curtains particularly compact and convenient for transportation and carrying at site. In addition, the present invention relates to a guide rail for manually opened and closed type curtains for manually opening and closing the curtain.

To a guide rail used for electrically-opened and closed curtains, etc., a string that serves as a line for opening and closing a curtain is wound around pulleys arranged on both ends of the guide rail and tensioned in a form of loop, and the string is normally and reversely moved by normally and reversely driving a motor linked to the pulley on one end to open and close the curtain linked to the string.

When this kind of curtain is repeatedly used, the string becomes loose due to wear in the string and changes in temperature and humidity of the surrounding environment, and it is inevitable that the string slacks.

When slack is generated in the string, even if the curtain open/close switch is turned on to drive the motor, slipage occurs between the pulley l-inked to the motor and the string, the pulley idles, the curtain is unable to be opened and closed, or even if it can be opened or closed, time-lag is generated between when the curtain open/close switch is turned on and when the curtain actually begins to open or close. In addition, there is an inconvenience in that the slackened portion of the string hangs down from the guide rail and is visible from outside, which looks ugly.

To counteract this situation, there proposed is a device which links the string For opening and closing the curtain to the curtain, and imparts string stretching capabilities to the runner for securing the curtain to the guide rail, in particular, so-called leading runner for securing the head part of the curtain (Japanese Utility Model Application laid-Open No. 2-6584 (1990), and Japanese Utility Model Application Laid-Open No. 3-113679 (1991)).

In the leading runner disclosed in the above utility model applications, there are an adjusting bolt and a bracket that moves longitudinally by rotation of the adjusting bolt on the side of the leading runner, and by connecting both ends of the string to this bracket, the bracket is moved reversely by rotating the adjusting bolt manually with a screwdriver when any slackness occurs in the string, and the string slackness is absorbed.

In the conventional leading runner as described above, since every time slackness occurs in the string, the adjusting bolt must be rotated manually with a screwdriver to remove the slackness, it has problems of troublesome operation and bulkiness because of the bracket and the adjusting bolt for linking the string, as well as increased cost due to the increased number of parts for the leading runner.

The electrically opened and closed type curtains are used not only for homes but also buildings, etc. particularly with wide windows, but unlike the cases of manually opened and closed type, it is necessary to mount an electrically-operated motor, a pulley, a winch, leading runners, a string to link across these, etc. Since, in particular, it is essential to provide proper tension to the string and the operation efficiency is poor to carry out these operations at site, the parts described above are assembled to the guide rail at the time of shipment from the plant.

However, in the case of the curtain to be set with a large window, the guide rail becomes long, creating another problem in that it is not easy to transport the guide rail to the site for setting as assembled and to carry out installation.

In addition, the guide rail for manually opened and closed type curtains is constructed by slidably fitting a plurality of freely moving runners to the guide rail body with an inverted U-letter cross-section, to these freely moving runners, the top end portions of the left and right curtains are hung via hooks, and the left and right curtains are opened and closed individually by holding the right and left curtains directly by hand or by using the pulling string or button equipped to the top portion of the curtains.

However, in above-mentioned guide rail, since a plurality of freely moving runners are simply slidably fitted, to which one or two curtains are hung, when these are opened or closed, the curtains must be moved from one side to the other side or from the window center to the right and left sides directly by hand or with pulling string or button in hand, causing a problem in that the operation is extremely troublesome in the case of long curtains.

SUMMARY OF THE INVENTION

The present invention has been made to solve the problems as described above, and accordingly, it is an object of the present invention to provide a runner equipped with compact and inexpensive line tension functions that can maintain a line for opening and closing a curtain automatically and constantly to the tension state as well as to provide a curtain opening and closing device using the runner.

It is another object of the present invention to provide a guide rail for curtains which has various parts equipped to the guide rail, that is, which has been finished with assembly, and requires only installation work at site, and in addition, is easy to transport, carry at site, and attachment.

In addition, it is still another object of the present invention to provide a guide rail for manually opened and closed type curtains, which enables right and left curtains to be opened and closed simultaneously by directly pulling the curtain or an operating string at the center portion or on one side of the window.

The runner according to this invention is linked with the line for opening and closing the curtain tensioned in the form of a loop and is equipped with a line tension function for holding the curtain to be opened or closed as the line moves, and comprises a pair of stopper members oppositely disposed with a predetermined clearance provided in the moving direction of the line, and an elastic member located between both of the stopper members to have its moving area limited and held to an extended state by linking one end portion to one end of the line and the other end portion to the other end of the line.

Consequently, linking the line to the elastic member extended which is disposed on the runner enables the elastic member to automatically absorb slackness generated in the line by its contracting action as well as enables the line to be held constantly to the tension state.

The guide rail for electrically opened and closed type curtains according to this invention for supporting the curtains and guiding the moving direction thereof comprises a motor, a pulley disposed at one end portion of the guide rail, a winch disposed at the other end portion of the guide rail and attached to the motor, a line for opening and closing the curtain laid between the pulley and the winch and tensioned in the form of a loop, and a leading runner intermediately linked to part of the line, movably placed between the pulley and the winch, and supporting the top end portion of the curtain, wherein the leading runner comprises a pair of stopper members oppositely disposed with a predetermined clearance provided in the moving direction of the leading runner and an elastic member located between the stopper members, having the moving area limited, being held to an extended state, and linking its one end portion to one end of the line and its other end portion to the other end of the line, respectively, and the line is wound around the winch by two or more turns.

Consequently, in addition to the above-mentioned effects, installing two or more turns to the winch can prevent slippage between the line and the winch even if a slight slackness occurs in the line and also can prevent the winch from running idle.

The guide rail for electrically opened and closed type curtains according to this invention is divided at one or a plurality of places in the longitudinal direction, and comprises a guide rail body constructed by a plurality of guide rail segments, and bendable couplers linking end portions of the guide rail segments in a series.

Consequently, bending the couplers can make the long curtain guide rail compact, achieving easy storage, transportation, and conveyance, and extending the couplers enables the installation of the guide rail to window frames as it is, achieving easy and rapid installation work.

The guide rail for manually opened and closed type curtains according to this invention comprises a guide rail body with a cross section of inverted U-letter form, pulleys pivoted to both end portions of the guide rail body, respectively, a line in the form of loop laid between both the pulleys, a pair of leading runners and at least one free-moving runner slidably fitted to the guide rail body, intermediately installed to part of the loop-form line.

Consequently, since each of the leading runners is linked to the loop-form line, directly holding by hand and pulling either one of the curtains linked to the leading runner enables both curtains to open and close simultaneously.

The guide rail for manually opened and closed type curtains according to the invention comprises an operating string or a button mounted to either one of the pair of leading runners.

Consequently, the guide rail can simultaneously open or close right and left curtains by operating the operating string or the button equipped to either one of the leading runners.

The guide rail for manually opened and closed type curtains according to the invention is characterized by the guide rail body divided at one or a plurality of places in the longitudinal direction and each divided portion linked with bendable couplers.

Consequently, because the guide rail body is bendably linked to the coupler, the long guide rail body can be easily carried and handled.

The guide rail for manually opened and closed type curtains according to the invention is characterized by the elastic member intermediately installed at the linked portion between the leading runner and the loop-form line.

Consequently, since the elastic member is intermediately installed at the linked portion between the leading runner and the loop-form line, the line can be maintained constantly to the tension state.

The guide rail for manually opened and closed type curtains according to the invention comprises both of the end portions linked to the line in the loop form at the leading runner or in the vicinity thereof, and the intermediate portion further equipped with an operating string pulled from one end portion of the guide rail body to the outside and a weight attached relatively movable to this operating string.

Consequently, since the operating string linked to the loop-form line is pulled out from one end portion of the guide rail body and the weight is equipped to the operating string, manipulating the operating string can simultaneously open or close the right and left curtains and at the same time the operating string can be maintained constantly to the tension state, thereby solving the inconvenience such as the operating string hangs down from the guide rail body.

Because the operating string hangs down from the guide rail body in parallel, inconvenience such as untwisting and manipulating the operating string every time the curtain is opened or closed by the user can be prevented.

The guide rail for manually opened and closed type curtains according to the invention is characterized by the loop-form line formed in a knot, and the operating string whose end portion is tied to the knot or the hook engaged.

Consequently, since the linkage between the operating string to the loop-form line is achieved by forming a knot in the loop-form string and directly connecting the end portion of the operating string to this, or by engaging a hook with this, there is no need for providing special processing to the leading runner and there is an advantage of easy assembly.

The above and further objects and features of the invention will more fully be apparent from the following detailed description with accompanying drawings.

DETAILED DESCRIPTION OF THE INVENTION

Referring now to drawings, the embodiments according to the invention will be described in detail.

First Embodiment

Figure 1:
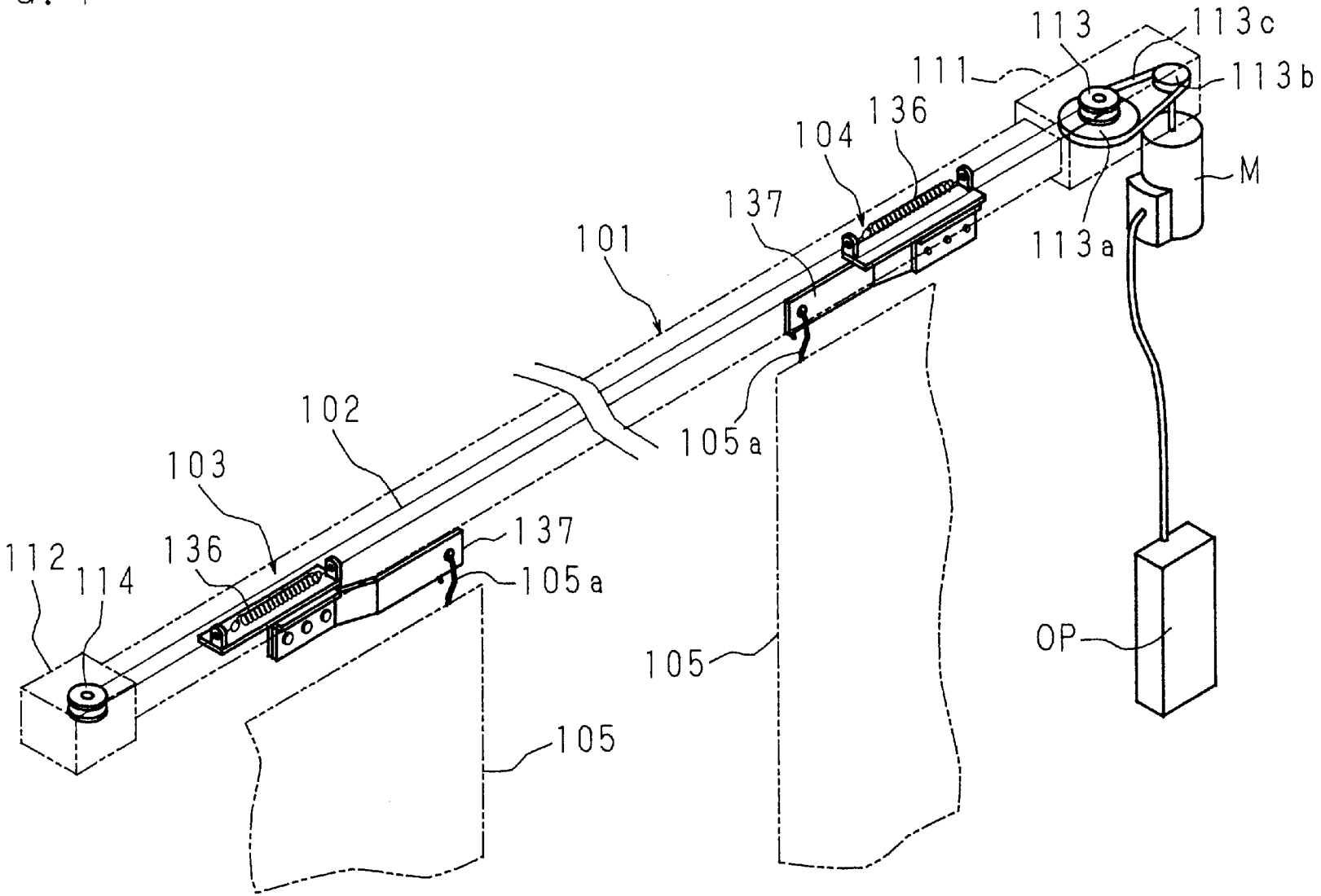
FIG. 1 is a perspective view showing the configuration of an electrically operated curtain opening and closing device applied with a runner of the first embodiment according to the invention or a curtain guide rail using this.
Figure 2:
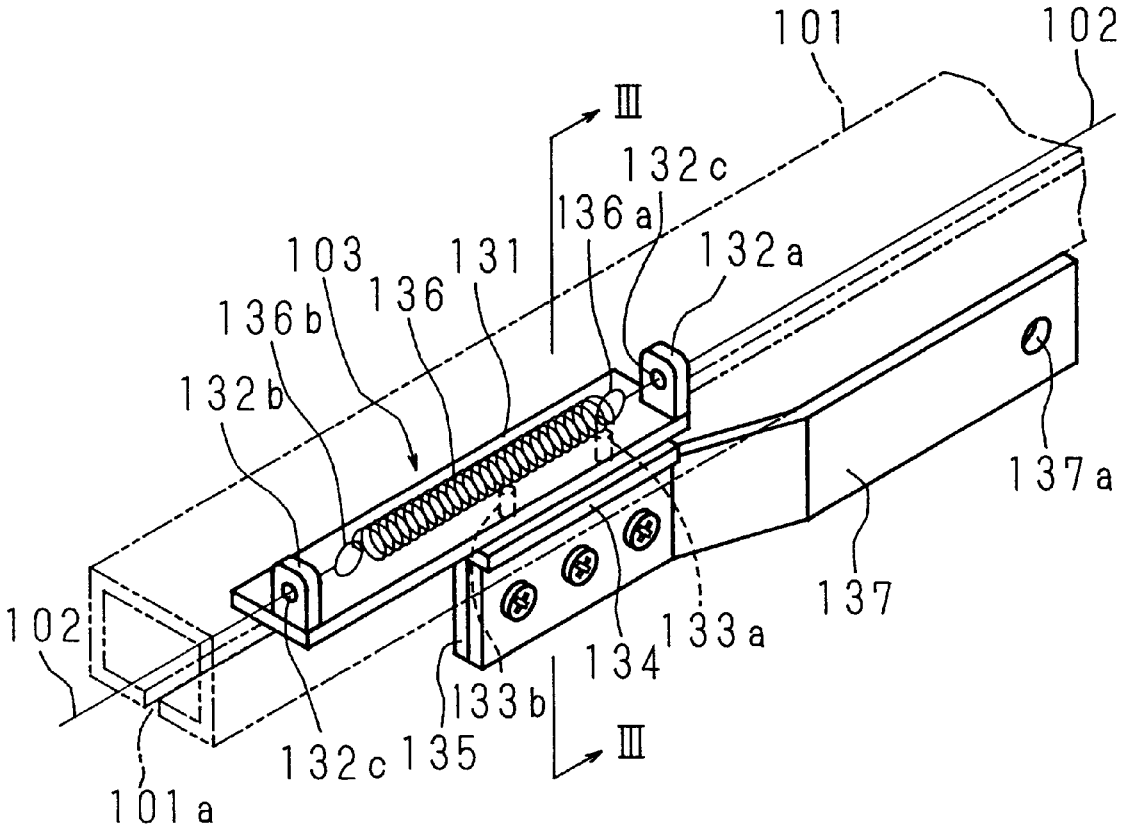
FIG. 2 is an enlarged perspective view of a leading runner according to the first embodiment.

FIG. 1 is a perspective view showing a configuration of a runner according to the invention and an electrically operated curtain opening and closing device applied with the curtain opening and closing guide rail using the runner, and FIG. 2 is an enlarged perspective view of a leading runner, and in the FIG. 1 and FIG. 2, numeral 101 designates a guide rail for opening and closing a curtain 105, numeral 102 designates a string serving as a line, numerals 103, 104 designate leading runners, numeral 105 a curtain, reference character M designates a motor, and reference character OP designates an operating section.

The guide rail 101 is formed in a downward nearly C-letter form as seen from the cross section, and as shown in FIG. 2, a guide groove 101*a* is equipped along the bottom center portion, caps 111, 112 are externally fitted to fix in such a manner to cover open ends in both ends of the guide rail 101, respectively, and the guide rail 101 is laid, for example, along the top frame of the window, etc.

Inside the guide rail 101, the string 102 serving as a line laid over both caps 111, 112 is laid in the form of a loop, and to the guide rail 101, the two leading runners 103, 104 intermediately installed in the midway of the string 102 and linked to the top end portion of the curtain 105 are slidably freely fitted.

In the cap 111, a winch 113 equipped with a U-letter-form groove and in the other cap 112, a pulley 114 equipped with a V-letter-form groove are pivoted with the shaft in the vertical direction, respectively, and the string 102 is tensioned in the form of a loop between the winch 113 and the pulley 114.

The winch 113 is made of urethane rubber, and is intended to achieve anti-slipping functions against the string 102. The pulley 114 is made of resin or metal such as aluminum.

The string 102 is formed with minimum the material with extendibility such as Kevler fiber or wire, etc., and placed in the form of a loop, and leading runners 103, 104 are intermediately installed at two places, nearly ½ the length of the loop. For the winch 113, the string 102 is wound by two or more turns, and for the pulley 114, the string is wound by 1 turn.

The winch 113 is equipped integrally with a gear 113*a* in a large diameter coaxially on one side, and a timing belt 113*c* is laid between this gear 113*a* and a small-diameter gear 113*b* mounted for rotation in parallel to the winch 113 in the cap 111.

To the gear 113*b*, an output shaft of the motor M is linked, and this motor M is designed to make normal and reverse rotations at the operating portion, or to be stopped at optional positions.

All leading runners 103, 104 have virtually the same construction, and therefore, the leading runner 103 on one side is specifically described.

Figure 3:
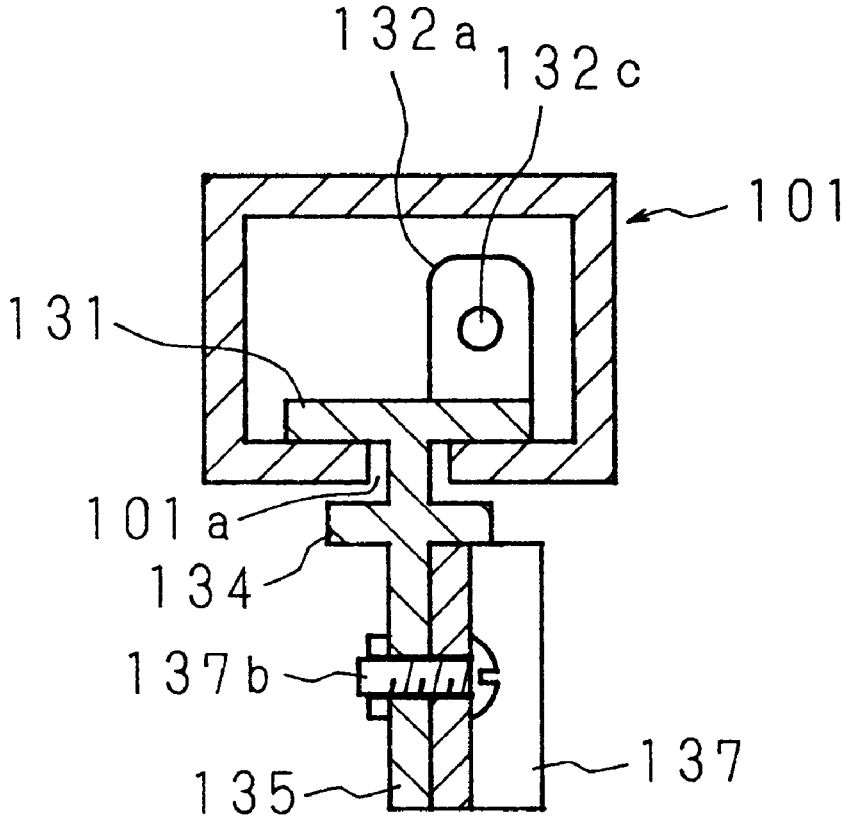
FIG. 3 is an enlarged cross-sectional view taken on line III—III of FIG. 2.
Figure 4A:
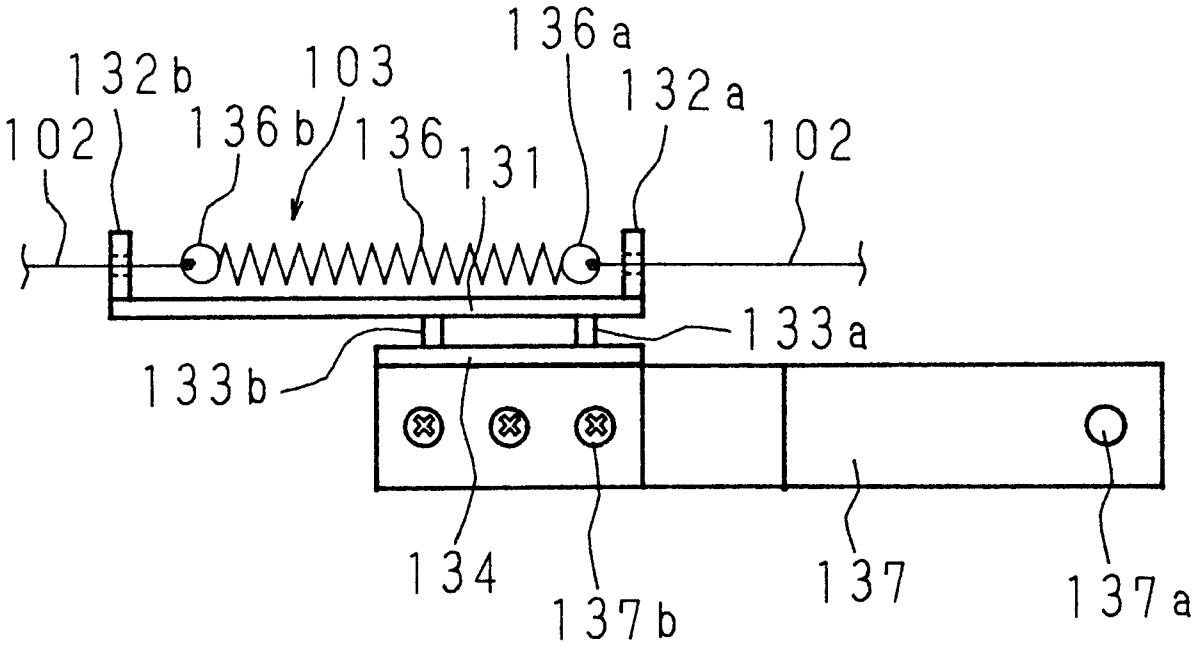
FIG. 4A and FIG. 4B, also referred to collectively as FIG. 4, are an enlarged front view and an enlarged left side view of the leading runner of FIG. 2.
Figure 4B:
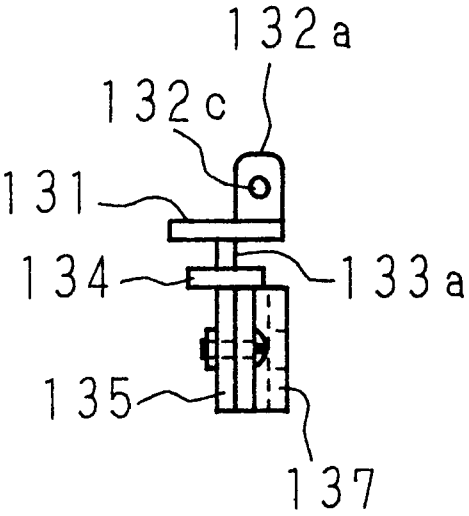

FIG. 3 is an enlarged cross-sectional view taken on line III—III of FIG. 2, and FIG. 4 and FIG. 4B are likewise an enlarged front view and an enlarged left side view of the leading runner, respectively. The leading runner 103 is integrally formed with synthetic resin with excellent wear resistance, and comprises as follows. As shown in FIG. 2, FIG. 3, FIG. 4A and FIG. 4B, a pair of stopper pieces 132*a*, 132*b* are erectly installed face to face, respectively, on both end portions on the top surface of an upper guide piece 131 that forms a long rectangular plate shape as seen on the plane.

And on the bottom surface of the top guide piece 131, a pair of guide rods 133*a*, 133*b* are perpendicularly installed with a predetermined clearance provided in the longitudinal direction in an area one half on the top end side, and a lower guide piece 134 is installed in parallel to the upper guide piece 131 on the bottom ends of both guide rods 133*a*, 133*b*. In addition, on the bottom surface of this bottom guide piece 134, a fixing piece 135 is downward installed to form a T-letter shape with the bottom guide piece to compose the runner body, and a coil spring 136 is disposed between the stopper pieces 132*a*, 132*b* in this runner body. A hanger rod 137 of the curtain 105 is fixed to the fixing piece 135.

The coil spring 136 is formed shorter than the distance between both stopper pieces 132*a*, 132*b* with no tension or no compression force applied, and to both end portions, fixing rings 136*a*, 136*b* are equipped for connecting each end portion of the string 102, and to these fixing rings 136*a*, 136*b*, each one end of the string 102 which passes through a hole 132*c* of the stopper pieces 132*a*, 132*b* is bound.

With the string 102 connected to the coil spring 136, the coil spring 136 is in the condition extended to a predetermined length, and when the string 102 is pulled in either direction, fixing rings 136*a*, 136*b* collide against stopper pieces 132*a*, 132*b* and moving area of the coil spring 136 is restricted, and the relative movement of the string 102 and the leading runner 103 is intended to be hindered.

Needless to say, any elastic member such as rubber, etc. can be used in place of the coil spring 136.

The hanger rod 137 is made of metal, and as shown in FIG. 2 and FIG. 4, it is bent at two positions at the intermediate portion with a predetermined clearance provided, and formed in such a manner that both end portions are extended oppositely in parallel to each other, and with the head portion with a hole 137*a* stretched towards the side front on the head end of the runner body, the base portion is fixed to the fixing piece 135 with fixing screws 137*b*, and a hanger 105*a* of the curtain 105 is engaged as shown in FIG. 1, to the hole 137*a*.

The leading runner 103 is slidably fitted to the guide rail 101 with the top guide piece 131 and stopper pieces 132*a*, 132*b* positioned on both ends inside the guide rail 101, and in addition, with the bottom guide piece 134, fixing piece 135, and the hanger rod 137 positioned outside the guide rail 101, and furthermore with the guide rods 133*a*, 133*b* positioned inside the guide groove 101*a* of the guide rail 101 as shown in FIG. 3.

The leading runner 103 has primarily horizontal swinging to the guide rail 101 restricted with the guide rods 133*a*, 133*b* and primarily vertical swinging to the guide rail 101 with the top guide piece 131 and the bottom guide piece 134 while it is moving along the guide rail 101.

Figure 5A:
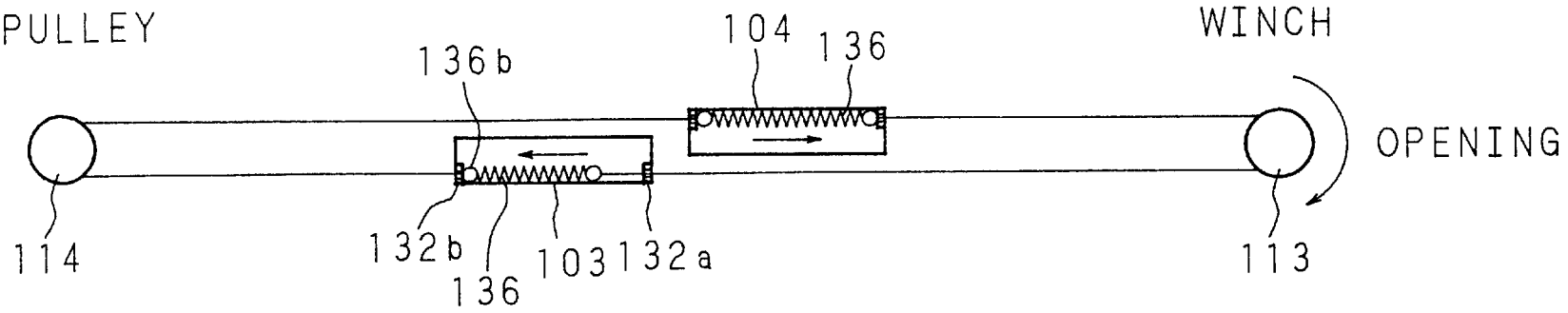
FIG. 5A and FIG. 5B, also referred to collectively as FIG. 16, are operation illustrations showing the relationship between the leading runner and a string according to the invention when the curtains are opened or closed.
Figure 5B:
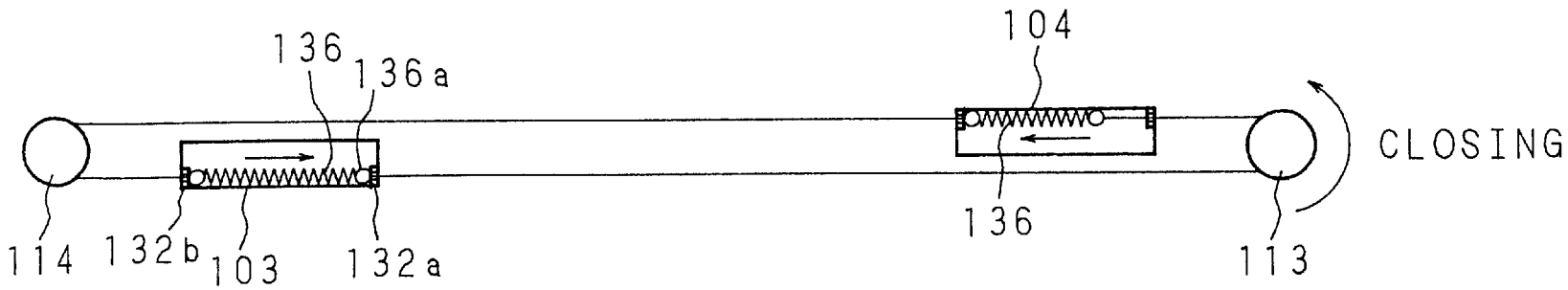

The operation of the embodiment as described above is discussed referring now to the operation illustrations shown in FIG. 5A, FIG. 5B.

With a motor M not driven, that is, when the curtain 105 is in the stationary state, the coil spring 136 installed to each of the leading runners 103, 104, respectively, is located nearly at the center of both stopper pieces 132*a*, 132*b* as shown in FIG. 2, FIG. 4A and FIG. 4B, and both fixing rings 136*a*, 136*b* are held not in contact with the stopper pieces 132*a*, 132*b*.

Now, as shown in FIG. 5A, the moment the motor M is driven with the curtain 105 closed and the string 102 is rotated in the arrow direction by the revolution of the winch 113, the string 102 is pulled by the revolution of the winch 113 on one side of the winch 113, and is slightly slackened on the other side, and as a result, in the leading runners 103, 104, the coil spring 136 is extended, respectively, and the fixing ring 136*b* moves to the position where it collides against the stopper piece 132*b*, and at the position, it begins moving integrally with the leading runners 103, 104, and the curtain 105 then begins to open.

On the other hand, as shown in FIG. 5B, when the curtain 105 is closed, when the motor M is driven and the string 102 is rotated by the revolution of the winch 113, the string 102 is pulled on one side by the revolution of the winch 113 and is slightly slackened on the other side, and as a result, in the leading runners 103, 104, the coil spring 136 is extended, respectively, and the fixing ring 136*a* moves to the position where it collides against the stopper piece 132*a*, and at the position, it begins moving integrally with the leading runners 103, 104, and the curtain then begins to close.

That is, the moment the motor M is driven, the coil spring 136 extends to alleviate impact applied to the string 102, and the life of the string 102 can be extended. In addition, while the curtain 105 is being closed or being opened, the string 102 has slack absorbed by the contraction force of the coil spring 136 and is held in a tension state, Furthermore, because the string 102 is wound around the winch 113 by more than two turns, and the string 102 itself is formed with a material such as wire, Kevler fiber, etc. with extremely small extensibility, slackness generated with time is little, and by properly establishing the extension length of both coil springs 136 can prevent it from slackening over a long period of time and can maintain it to the tension state.

In the embodiment 1 described above, the case in which function for applying tension to the line is provided to both leading runners 103, 104 is shown, but it may be provided to either one of the leading runners, or tension function may not be imparted only to the leading runner but to the intermediate runner.

In the embodiment 1, there shown is the case in which the invention is applied to the opening and closing device for curtains for windows but needless to say, it can be applied to any opening and closing device for curtains, etc. of, for example, theaters.

In addition, in embodiments, a both-opening type curtain opening and closing device is shown, but the invention can be applied to the device which opens and closes independently right and left curtains or to the curtain opening and closing devices for curved windows and skylights.

In the present embodiment, because the elastic member, under the extended state linked to both ends of the line, is placed between oppositely erectly installed stopper members, the line can be held constantly to the tension state by the contraction force, and inconveniences in that the curtains are not opened or closed by idle running of the drive source associated with the slackness of the line and time lag is generated between the operation of the drive source and the curtain opening and closing operations can be solved with inexpensive parts, and the present embodiment exhibits excellent effects in that impact resulting from rapid revolution of the drive source can be alleviated, etc.

In the present embodiment, in addition to the effects described above, by winding a line around the winch by more than two turns, occurrence of slippage is prevented between the winch and the line, and the line is maintained constantly to the tension state, and inconveniences such as failure to open or close the curtain resulting from idle running of the winch at the time of driving the winch or occurrence of delay in closing and opening operation of the curtain are solved.

Embodiment 2

Figure 6:
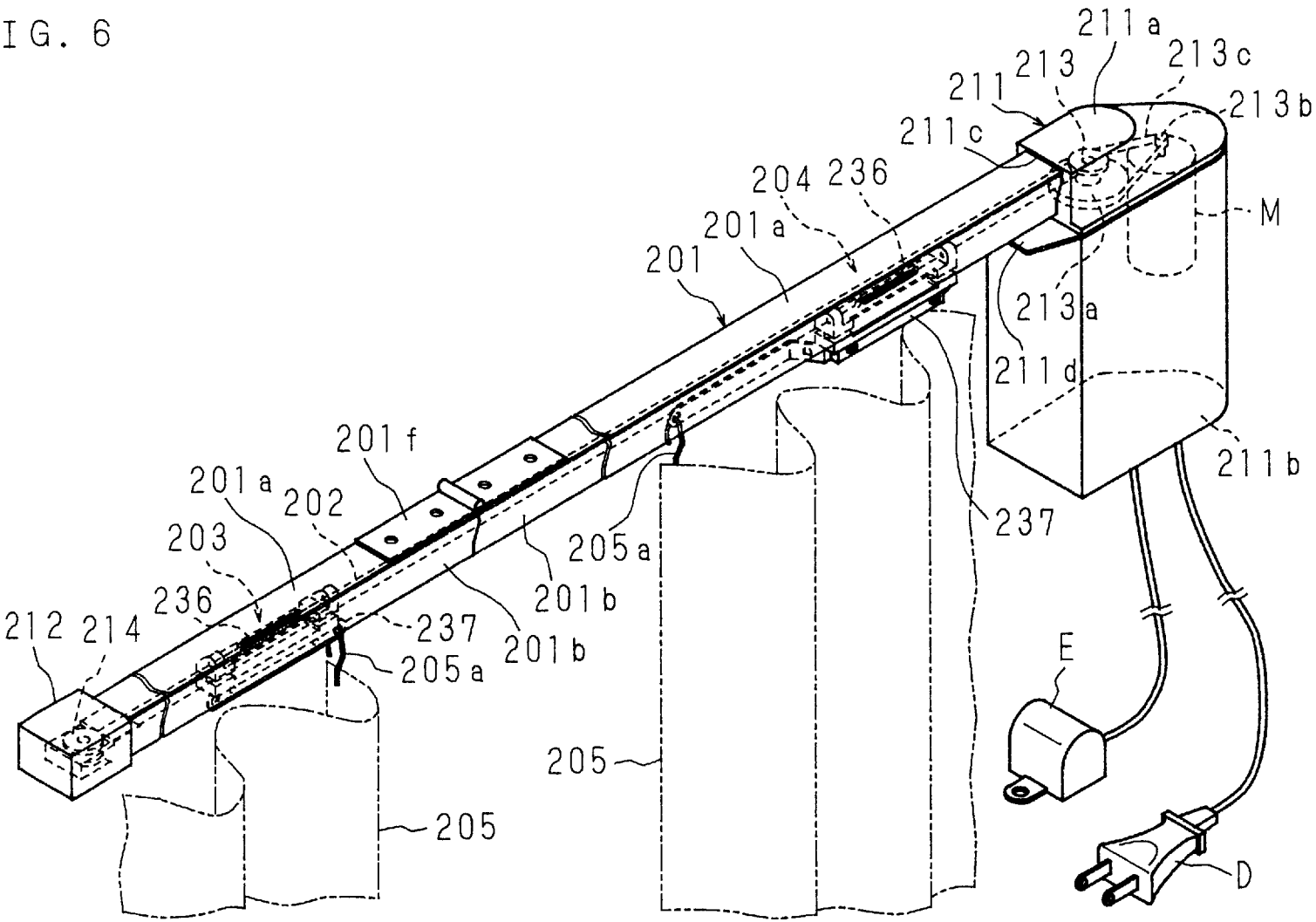
FIG. 6 is a perspective view showing the configuration of the guide rail for curtains according to embodiment 2.
Figure 7:
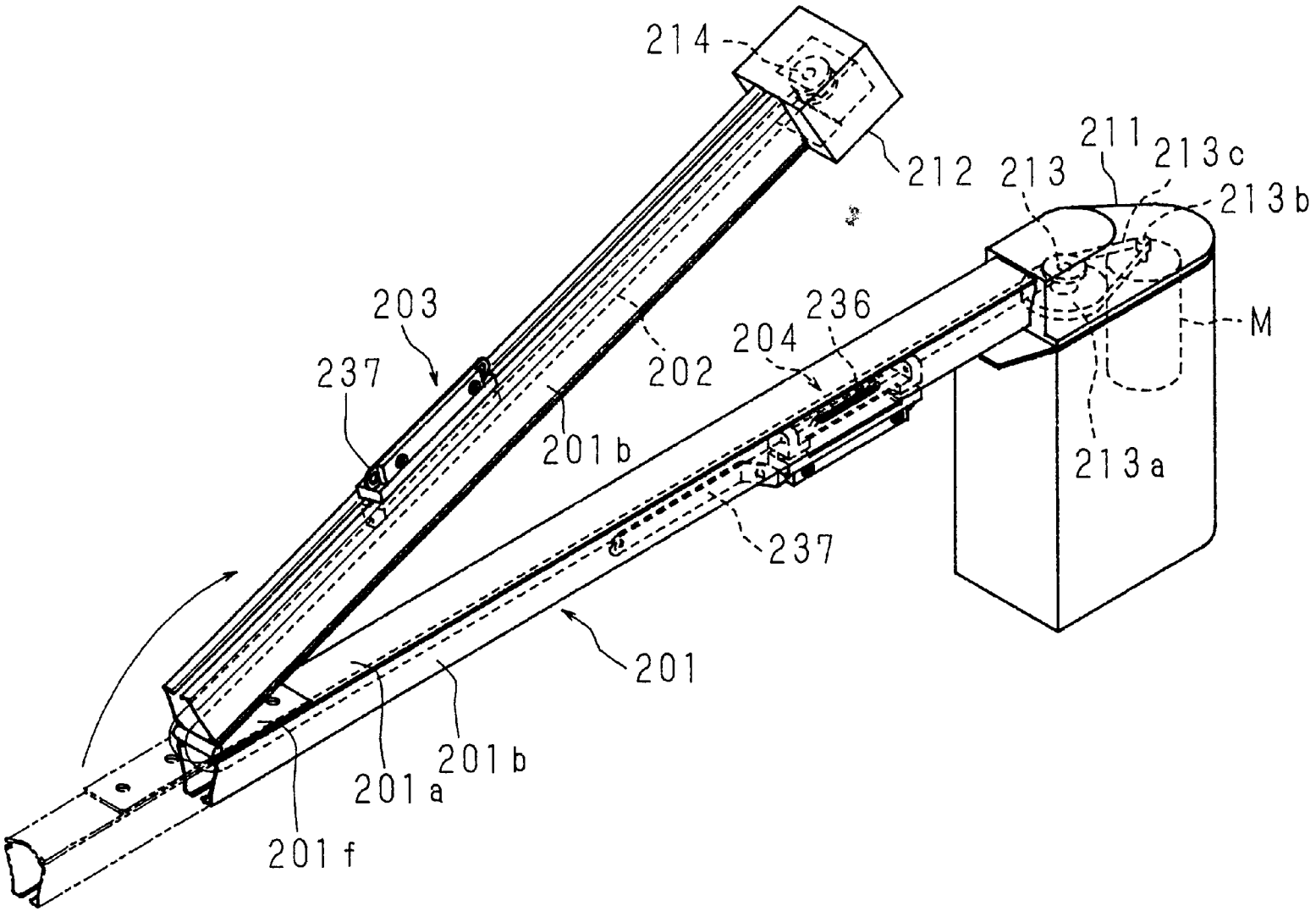
FIG. 7 is a perspective view showing the condition of the curtain guide rail folded of FIG. 6.

FIG. 6 is a perspective view showing a guide rail for electrically opened and closed type curtains according to embodiment 2, and FIG. 7 is an illustration showing the condition where the guide rail is folded, and in the drawing, numeral 201 designates a guide rail body for opening and closing of a curtain 205, 202 a string that serves for a line, 203 and 204 leading runners, M a motor, E a sensor portion for remote control, and D a receptacle for power supply, respectively.

Figure 8:
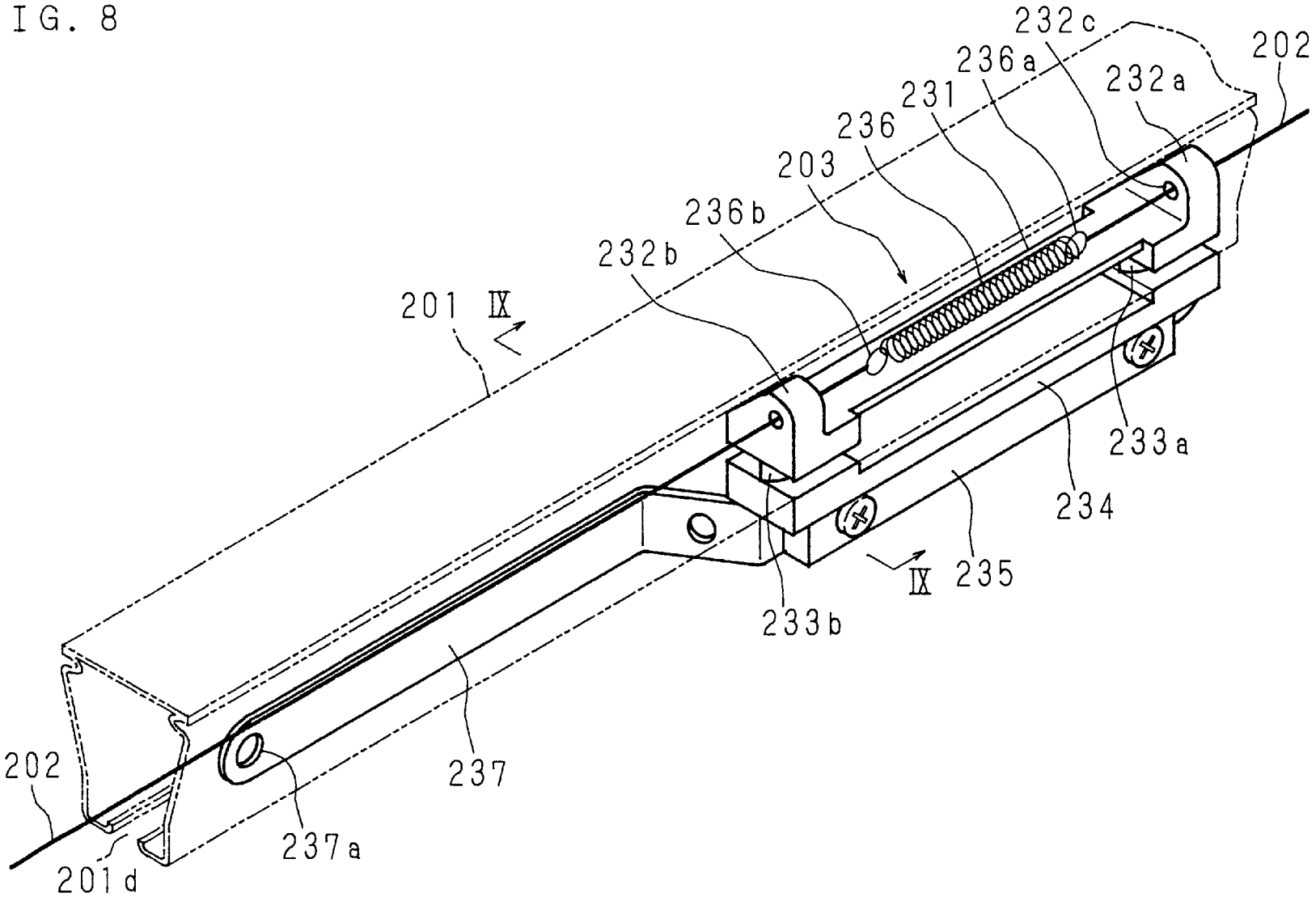
FIG. 8 is an enlarged perspective view of the leading runner of the embodiment 2.

The guide rail body 201 is formed in a nearly C-letter form (see FIG. 8) with the cross section directed downward as shown in FIG. 8, and equipped with a guide groove 201*d* along the bottom surface center portion, and on both ends, cases 211, 212 are externally fitted to fix in such a manner to cover the open ends, respectively, as shown in FIG. 6 and FIG. 7, and is intended to be laid along, for example, the top frame, etc. of the window. The guide rail body 201 is divided into two at the center portion in the longitudinal direction, and the end portions of the divided guide rails as the guide rail segments are bendably connected in the form of a line as shown in FIG. 7 by a hinge 201*f* as a coupler that can be bent, which is laid over the back plate 201*a* and fixed.

The hinge 201*f* is fixed to the back plate 201*a* of the guide rail body 201 with fixing screws or caulking. It is possible to lay both ends of soft connecting member such as leather piece or synthetic resin piece or canvas, etc. in place of the hinge 201*f* over the back plates 201*a* or side plates 201*b* and to fix one to the divided guide rails to connect them by screwing or caulking.

If the hinge 201*f* is used, when the guide rail is extended, the end faces of divided guide rails are immediately brought to the state in which the end faces are butted, producing an advantage that the fixing operation can be carried out more efficiently. The height of the hinge 201*f* is desirable not to exceed the wall thickness of the cases 211, 212 attached to both ends.

The case 211 is a square tube, with the top end portion designed to be closed with a cap 211*a* and the bottom end portion with a bottom lid 211*b*. To the cap 211*a*, a hole 211*c* for introducing one end portion of the guide rail body 201 is opened, to which one end portion of the guide rail body 201 is introduced and is fixed integrally with fixing screws. On the bottom portion of the cap 211*a*, a fixing plate 211*d* is fixed, and to the fixing plate 211*d*, a winch 213 and the motor M are vertically installed, respectively. The winch 213 is made of urethane rubber, with a U-letter-form groove provided on the upper portion for winding the string 202 and the lower portion provided with a gear portion for winding the timing belt 213*c*, and pivoted on an extension line of one end portion of the guide rail body 201. The motor M is fixed with the output shaft aligned in parallel to the shaft of the winch 213, and between a small-diameter gear 213*b* installed on the output shaft and the winch 213, a timing belt 213*c* is tensionally installed.

The motor M is rotated normally and reversely by the operating portion for remote control which is not illustrated and is stopped at an optional position.

A bottom lid 211*b* of the case 211 is removably mounted to the bottom portion of the case 211 with fixing screws, through which cords for sensor E and receptacle D are passed.

On the other hand, the case 212 is formed into a hollow case, with a hole provided on one side wall for introducing the end portion of the guide rail body 201, and inside the case, a pulley 214 with a V-letter form groove equipped on the circumferential surface is pivoted with the shaft directed in the vertical direction in such a manner that the pulley is located on the extension line of the end portion of the guide rail body 201. The pulley 214 is made of resin or light metal such as aluminum, etc.

In the guide rail body 201, two of the leading runners 203, 204 to be linked to the head portion of the curtain 205 and freely moving runners for supporting the top end edge of the intermediate portion of the curtain are slidably and freely fitted, and the string 202 is stretched in a loop form by being laid over the winch 213, the pulley 214, and the leading runners 203, 204.

The string 202 is formed by using a material with extensibility as small as possible such as Kevler fiber or wire, etc., and is disposed in a loop form, and at two places in the position nearly one half the length of the loop, the leading runners 203, 204 are intermediately installed. To the winch 213, the string 202 is wound by two or more turns, and to the pulley 214, the string is wound by one turn.

Each of the leading runners 203, 204 have the virtually same construction, and therefore, the leading runner 203 on one side is specifically described.

Figure 9:
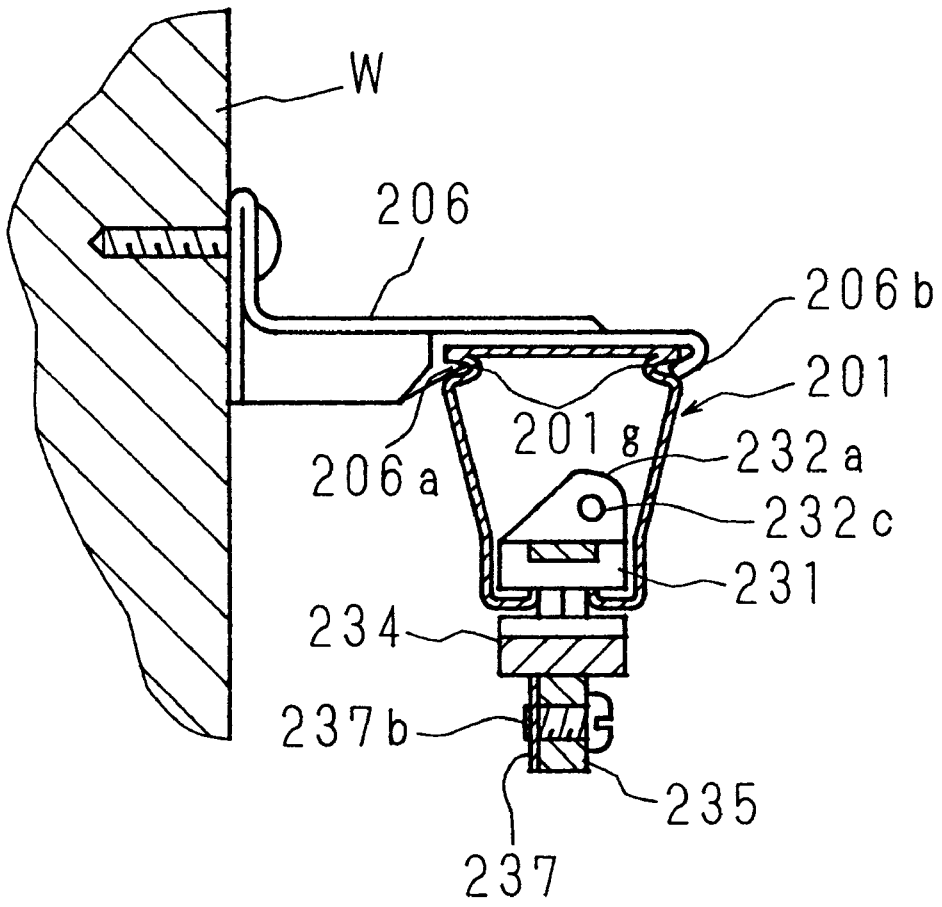
FIG. 9 is an enlarged cross-sectional view taken on line IX—IX of FIG. 8.
Figure 10:
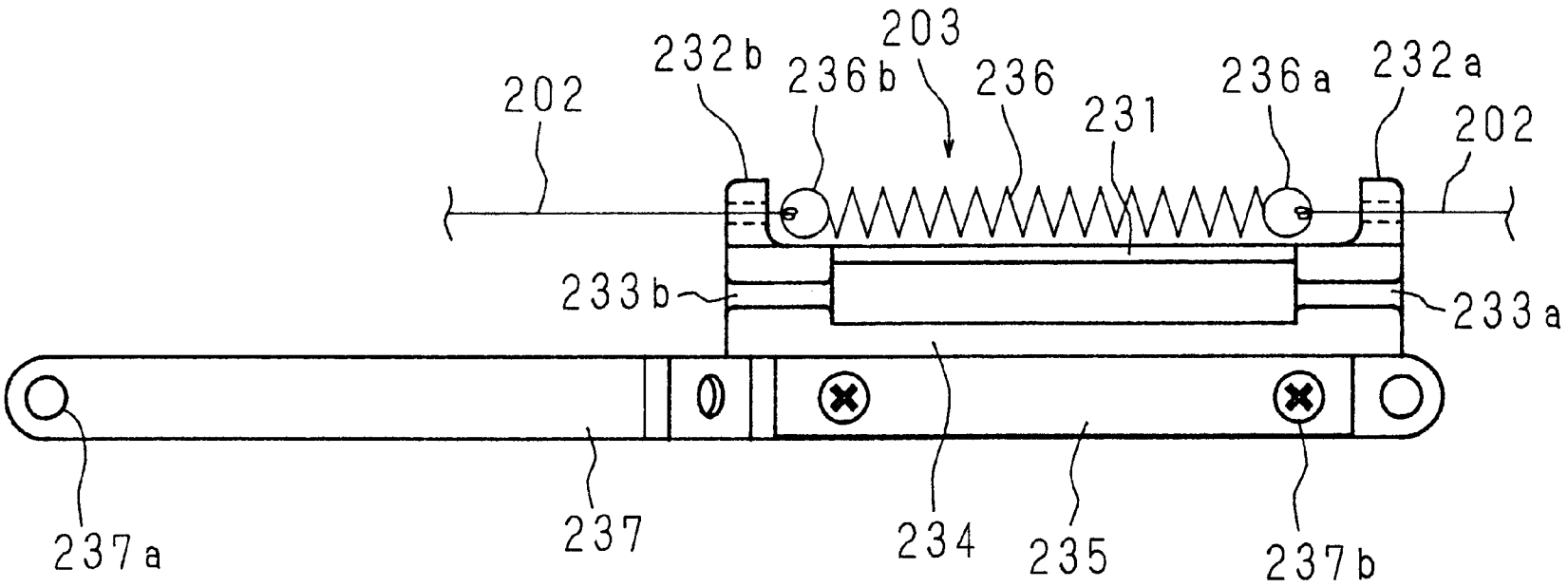
FIG. 10 is an enlarged front view of the leading runner of FIG. 8.

FIG. 8 is an enlarged perspective view of the leading runner 203, FIG. 9 is an enlarged cross-sectional view taken on line IX—IX of FIG. 8, and FIG. 10 is an enlarged front view of the leading runner, and the leading runner 203 is formed integrally with synthetic resin with excellent wear resistance, and as shown in FIG. 8 to FIG. 10, a pair of stopper pieces 232*a*, 232*b* are erectly installed face to face respectively, on both end portions on the top surface of an upper guide piece 231 that forms a long rectangular plate shape as seen on the plane, while on the bottom surface of the top guide piece 231, a pair of guide rods 233*a*, 233*b* are perpendicularly installed with a predetermined clearance provided in the longitudinal direction in an area one half on the top end side, and a lower guide piece 234 is installed in parallel to the upper guide piece 231 on the bottom ends of both the guide rods 233*a*, 233*b*, and in addition, on the bottom surface of this bottom guide piece 234, a fixing piece 235 is downward installed to form a T-letter shape with the bottom guide piece to compose the runner body, and a coil spring 236 is disposed between the stopper pieces 232*a*, 232*b* in this runner body, and a hanger rod 237 of the curtain 205 is fixed to the fixing piece 235.

The coil spring 236 is formed shorter than the distance between both stopper pieces 232*a*, 232*b* with no tension or no compression force applied, and to both end portions, fixing rings 236*a*, 236*b* are equipped for connecting each end portion of the string 202, and to these fixing rings 236*a*, 236*b*, each one end of the string 202 allowed to pass a hole 232*c* of the stopper pieces 232*a*, 232*b* is bound.

With the string 202 connected to the coil spring 236, the coil spring 236 is in the condition extended to a predetermined length, and when the string 202 is pulled in either direction, fixing rings 236*a*, 236*b* collide against stopper pieces 232*a*, 232*b* and moving area of the coil spring 236 is restricted, and the relative move of the string 202 and the leading runner 203 is intended to be hindered.

Needless to say, any elastic member such as rubber, etc. can be used in place of the coil spring 236.

The hanger rod 237 is made of metal, and as shown in FIG. 8 and FIG. 10, it is bent at two positions at the intermediate portion with a predetermined clearance provided, and formed in such a manner that both end portions are extended oppositely in parallel to each other, and with the head portion with a hole 237*a* stretched towards the side front on the head end of the runner body, the base portion is fixed to the fixing piece 235 with fixing screws 237*b*, and a hanger 205*a* of the curtain 205 is engaged as shown in FIG. 6 to the hole 237*a*.

The leading runner 203 is slidably fitted to the guide rail body 201 with the top guide piece 231 and stopper pieces 232*a*, 232*b* positioned on both ends inside the guide rail 201, and in addition, with the bottom guide piece 234, fixing piece 235, and the hanger rod 237 positioned outside the guide rail body 201, and furthermore with the guide rods 233*a*, 233*b* positioned inside the guide groove 201*a* of the guide rail body 201 as shown in FIG. 9.

The leading runner 203 has primarily horizontal swinging to the guide rail body 201 restricted with the guide rods 233*a*, 233*b* and primarily vertical swinging to the guide rail body 201 with the top guide piece 231 and the bottom guide piece 234 while it is moving along the guide rail body 201.

The guide rail is assembled in the plant by mounting the leading runners 203, 204 to the string 202 with a linkage portion by a hinge 201*f* extended in a straight line and stretching the string between the winch 213 and the pulley 214 with proper tension provided.

At the time of shipment, the guide rail is bent into two portions at the hinge 201*f*, packed in the shortened form into a a carton or packaged for shipment. When the guide rail is bent into two portions, the string 202 is pulled more strongly, but both ends of the string 202 are linked to the coil spring 236 which is an elastic member in the leading runners 203, 204, and by extension of the spring 236, the increased tension of the string 202 associated with the bending is alleviated, and it thereby becomes possible to prevent large tightening force from being exerted on the pulley 214 and the winch 213. In addition, bulkiness of the guide rail can be reduced during transportation, and transportation cost can be reduced, and carrying the guide rail as it is to the installation site, unpacking, and extending the linkage portion by the hinge 201*f* as it is causes both end faces of the guide rail body 201 to butt each other to extend in a line, and enables immediate installation.

The guide rail body 201 is fixed to a wall W by screwing supporters 206 at proper spacing as shown in FIG. 9, and engaging the recessed grooves 201*g* formed at the upper part of the guide rail body 201 between latching pawls 206*a* and 206*b* formed on the bottom surface of the horizontally overhung arm portion of the supporters 206.

The opening and closing operations of the curtain according to embodiment 2 as described above are similar to those of embodiment 1 described above (see FIG. 5). That is, the moment the motor M is driven, the coil spring 236 extends to alleviate impact applied to the string 202, and the life of the string 202 can be extended. In addition, while the curtain 205 is being closed or being opened, the string 202 has slack absorbed by the contraction force of the coil spring 236 and is held in a tension state.

Furthermore, because the string 202 is wound around the winch 213 by not less than two turns, and the string 202 itself is formed with a material such as wire, Kevler fiber, etc. with extremely small extensibility, slackness generated with time is little, and by properly establishing the extension length of both coil springs 236 can prevent it from slackening over a long period of time and can maintain it to the tension state.

In the embodiments 1, 2 described above, there described are cases in which the guide rail body for curtains is divided into two portions, but needless to say, it may be divided in a plurality of portions.

In the embodiments, there shown is the case in which the invention is applied to the guide rail for curtains for windows, but needless to say, it can be applied to guide rails for curtains, etc. of, for example, theaters, guide rails bent in an arc, or guide rails for manually opened and closed type curtains.

In this embodiment, bulkiness is reduced by folding a long guide rail body, and the guide rail can be transported and carried in a compact form, and easy handling is achieved.

In this embodiment, the guide rail is folded with an electrically operated motor, pulley, winch, string, etc. assembled to the guide rail body, and is transported and carried to the site under this state for easy handling, and the guide rail can be installed as it is by extending the linkage portion, and easy installation work is achieved.

Embodiment 3

Figure 11:
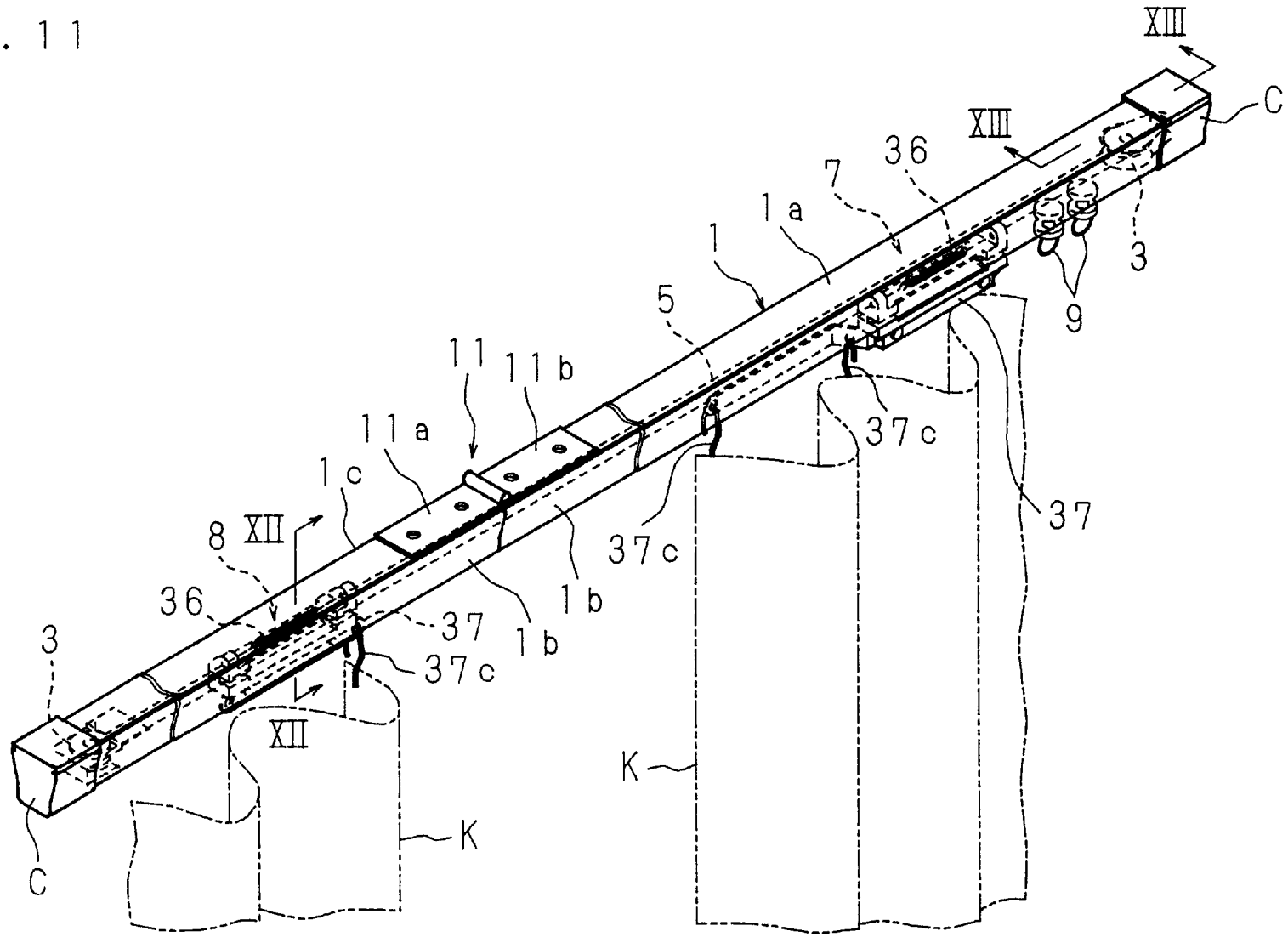
FIG. 11 is a perspective view showing the configuration of curtain guide rail of embodiment 3 according to the invention.
Figure 12:
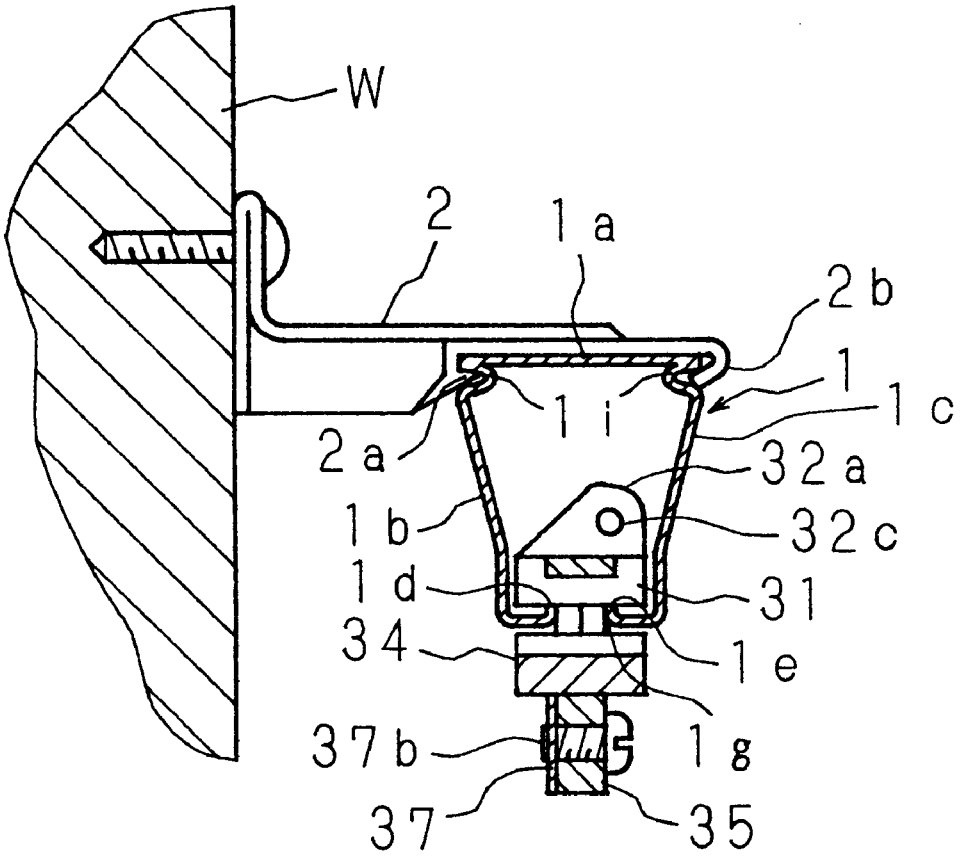
FIG. 12 is a cross-sectional view taken on line XII—XII of FIG. 11.
Figure 13:
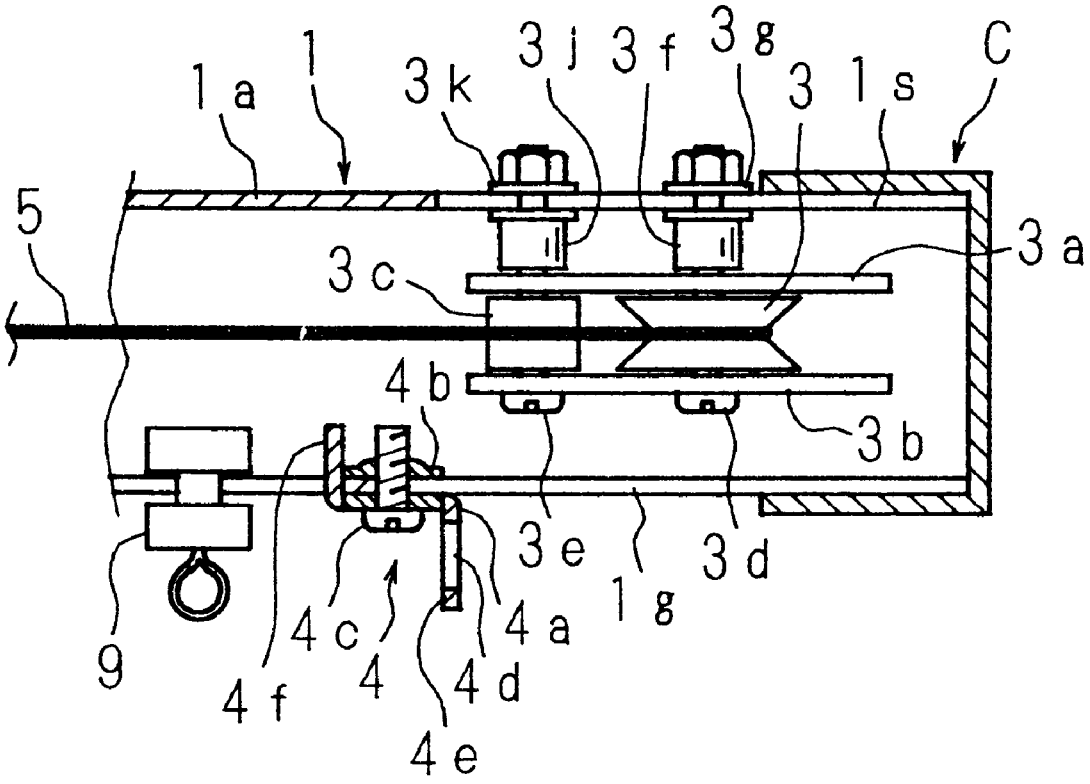
FIG. 13 is an enlarged cross-sectional view taken on line XIII—XIII of FIG. 11.
Figure 14:
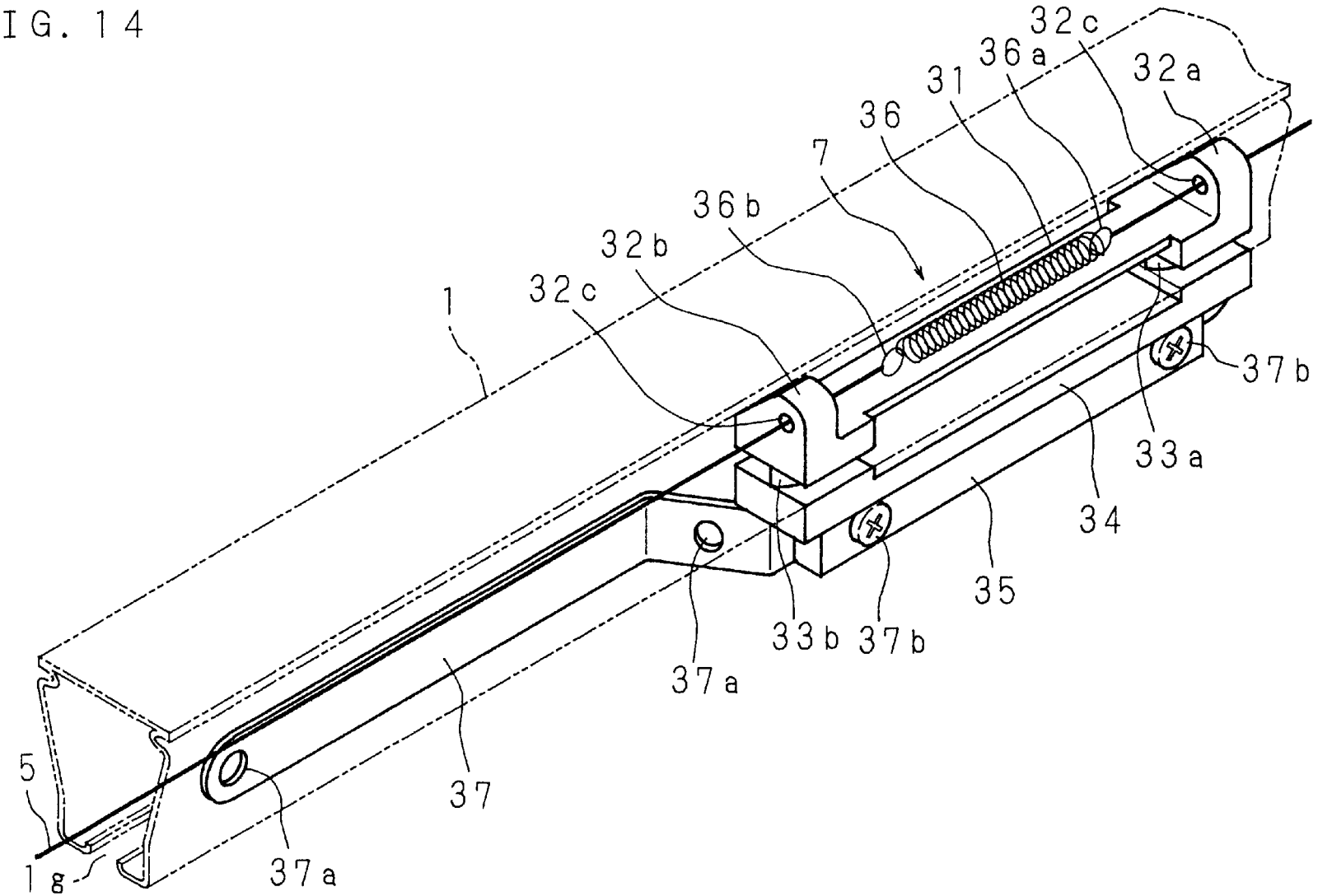
FIG. 14 is an enlarged perspective view of the leading runner of FIG. 11.
Figure 15:
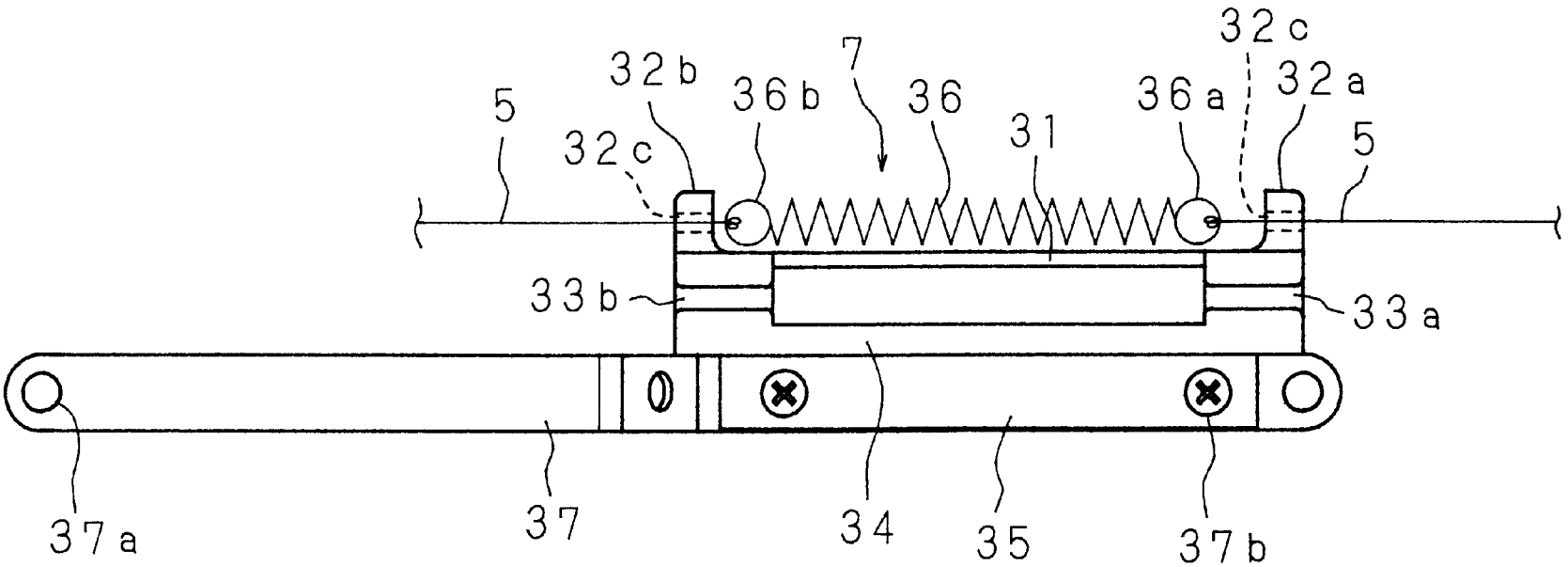
FIG. 15 is an enlarged front view of the leading runner of FIG. 11.

FIG. 11 is a perspective view showing a configuration of the guide rail for manually opened and closed type curtains according to Embodiment 3, FIG. 12 is a cross-sectional view taken on line XII—XII of FIG. 11, FIG. 13 is an enlarged cross-sectional view taken on line XIII—XIII of FIG. 11, FIG. 14 is an enlarged perspective view of the leading runner, and FIG. 15 is an enlarged front view of the leading runner. In the figure, numeral 1 designates a guide rail body, 2 a support frame for wall W, 3 a pulley, 7, 8 leading runners, and K a curtain.

Inside of the guide rail body 1, a pair of leading runners 7, 8 with the pulleys 3 pivoted, respectively on both end portions for laying a loop-form string 5 over both the pulleys 3 as well as for hanging the curtain K to the guide rail body 1 and a plurality of freely moving runners 9 are slidably fitted to the guide rail body 1, and the pair of leading runners 7, 8 are linked to the loop-form string 5 at two equally divided points of the loop-form string 5, respectively.

The guide rail body 1 is made of aluminum, and as shown in FIG. 12, comprises a back plate la, and right and left side plates 1*b*, 1*c*, and is formed to have an inverted U-letter form cross-section, and the bottom end edges of the right and left side plates 1*b*, 1*c* are bent oppositely to each other to form engaging edges 1*d*, 1*e*, and the space between these engaging edges 1*d*, 1*e* is made open to be served as a guide groove 1*g*. The upper end portion of the right and left side plates 1*b*, 1*c* are recessed throughout the full length of the guide rail body 1, and above them, both ends of the back plate la in the width direction are protruded outward to form protruded lines 1*i* and by engaging the engaging portions 2*a*, 2*b* of the support frame 2 fixed to the wall W to these protruded lines, the guide rail body 1 is mounted to the wall W.

In addition, at the nearly central portion of the guide rail body 1 in the longitudinal direction, the guide rail body 1 is divided into two portions, and at this divided position, for example, a hinge 11, a coupler that can be bent, which is laid between the back plates 1*a* of both divided guide rails body 1, is mounted to link the two divided portions as the guide rail segments.

That is, a fixing piece 11*a* in one side of the hinge 11 is integrally fixed to one back plate la of the divided guide rail body 1 and a fixing piece 11*b* in the other side of the hinge 11 is integrally fixed to the other back plate 1*a* of the divided guide rail body with bolts and nuts or rivets, respectively. With this configuration, the guide rail body 1 can be folded into two at the hinge 11, and when it is extended, the divided guide rails body 1 are butted at the divided end faces and are linked in the form of a line.

The hinge 11 may be mounted between side plates 1*b* or 1*c* as well as between back plates la of the guide rail body 1.

Because the pulleys 3 are installed in the guide rail body 1 in the virtually same form, the fixing form of the pulley 3 on one side is described referring now to FIG. 13.

The pulley 3 and a spacer 3*c* of nearly same height as that of pulley 3 intermediately installed in parallel between two parallel fixing plates 3*a*, 3*b*. Two bolts 3*d*, 3*e* are fitted with the fixing plate 3*b* and the bolt 3*d* is passed from the fixing plate 3*b* side on the lower side through the fixing plate 3*b*, the pulley 3, the fixing plate 3*a*, a spacer 3*f*, a washer 3*g*, and a slit Is formed on the back plate la of the guide rail body 1 and is fastened with a nut. On the other hand, the bolt 3*e* is passed the fixing plate 3*a*, the spacer 3*c*, the fixing plate 3*a*, a spacer 3*j*, a washer 3*k*, and the slit is of the guide rail body 1 and is fastened with a nut.

The spacers 3*c*, 3*f*, 3*j* are formed in a cylindrical form, and their axial length is set in such a manner that the pulley 3 is able to be positioned at the nearly central portion inside the guide rail body 1. The slit 1*s* is provided for adjusting the distance between pulleys 3 and for controlling tension to the loop-form string 5 laid over pulleys 3. Numeral 4 designates a fastener for fastening the end portion of the curtain K, and the fastener 4 comprises a pair of grasping pieces 4*a*, 4*b* for grasping both side edge portions of the guide groove 1*g* in the guide rail body 1 from the outside and inside of the guide groove 1*g* and a bolt 4*c* for tightening these, and to the outside grasping piece 4*a*, a hanging piece 4*e* with an engaging hole 4*d* for engaging a hanger 37*c* fixed to the top end portion of the curtain K is provided extending downward of the guide rail body 1, and on the other side, a contact piece 4*f* for stopping a freely moving runner 9 is extended from the guide groove 1*g* towards the inside of the guide rail body 1.

The loop-form string 5 is formed in a loop form using the material with extremely small extensibility such as Kevler fiber or wire, etc. and laid across the pulleys 3 described above, and at two places of the position nearly ½ the length of the loop, the string 5 is linked to the leading runners 7, 8 as shown in FIG. 14 and FIG. 15.

The leading runners 7, 8 have virtually same construction, and the leading runner 7 on one side is specifically described referring now to FIG. 14 and FIG. 15.

FIG. 14 is an enlarged perspective view of the leading runner 7, and FIG. 15 is an enlarged front view of the leading runner 7. The leading runner 7 is formed integrally with synthetic resin with excellent wear resistance, and a pair of stopper pieces 32*a*, 32*b* are erectly installed face to face, respectively, on both end portions on the top surface of an upper guide piece 31 that forms a long rectangular plate shape as seen on the plane, while on the bottom surface of the top guide piece 31, a pair of guide rods 33*a*, 33*b* are perpendicularly installed with a predetermined clearance provided in the longitudinal direction in an area one half on the top end side, and a lower guide piece 34 is installed in parallel to the upper guide piece 31 on the bottom ends of both the guide rods 33*a*, 33*b*, and in addition, on the bottom surface of this bottom guide piece 34, a fixing piece 35 is downward installed to form a T-letter shape with the bottom guide piece to compose the runner body as shown in FIG. 12, and a coil spring 36 is disposed between the stopper pieces 32*a* and 32*b* in this runner body, and a hanger rod 37 of the curtain K is fixed to the fixing piece 35.

The coil spring 36 is formed shorter than the distance between both stopper pieces 32*a* and 32*b* with no tension or no compression force applied, and to both end portions, fixing rings 36*a*, 36*b* are equipped for connecting each end portion of a loop-form string 5, and to these fixing rings 36*a*, 36*b*, each one end of the loop-form string 5 allowed to pass a hole 32*c* of the stopper pieces 32*a* and 32*b* is bound.

With the loop-form string 5 connected to the coil spring 36, the coil spring 36 is in the condition extended to a predetermined length, and when the loop-form string 5 is pulled in either direction, fixing rings 36*a*, 36*b* collide against stopper pieces 32*a*, 32*b* and moving area of the coil spring 36 is restricted, and the relative move of the loop-form string 5 and the leading runner 7 is allowed only between stopper pieces 32*a*, 32*b*.

Needless to say, any elastic member such as rubber, etc. can be used in place of the coil spring 36.

The hanger rod 37 is made of metal, and as shown in FIG. 14 and FIG. 15, it is bent at two positions at the intermediate portion with a predetermined clearance provided, and formed in such a manner that both end portions are extended oppositely in parallel to each other, and with the head end portion with a hole 37*a* stretched towards the side front on the head end of the runner body, the base portion is fixed to the fixing piece 35 with fixing screws 37*b*, and a hanger 37*c* of the curtain K is engaged an shown in FIG. 11 to the hole 37*a*.

The leading runner 7 is slidably fitted to the guide rail body 1 with the top guide piece 31 and stopper pieces 32*a*, 32*b* positioned on both ends inside the guide rail body 1, and in addition, with the bottom guide piece 34, fixing piece 35, and the hanger rod 37 positioned outside the guide rail body 1, and furthermore with the guide rods 33*a*, 33*b* positioned inside the guide groove la of the guide rail body 1 as shown in FIG. 14 and FIG. 15.

The leading runner 7 has primarily horizontal swinging to the guide rail body 1 restricted with the guide rods 33*a*, 33*b* and primarily vertical swinging to the guide rail body 1 with the top guide piece 31 and the bottom guide piece 34 while it is moving along the guide rail body 1.

The leading runner 8 has virtually same construction with only exception in that the hanger rod 37 of the curtain K mounted to the leading runner 8 is shorter than that of the leading runner 7 and there is little overhang from the top end of the runner body 1, and is slidably fitted with the direction opposite to the guide rail body 1, that is, to achieve right and left symmetricy.

Reference character C is a cap removably externally fitted to both end portions of the guide rail body 1.

Figure 16A:
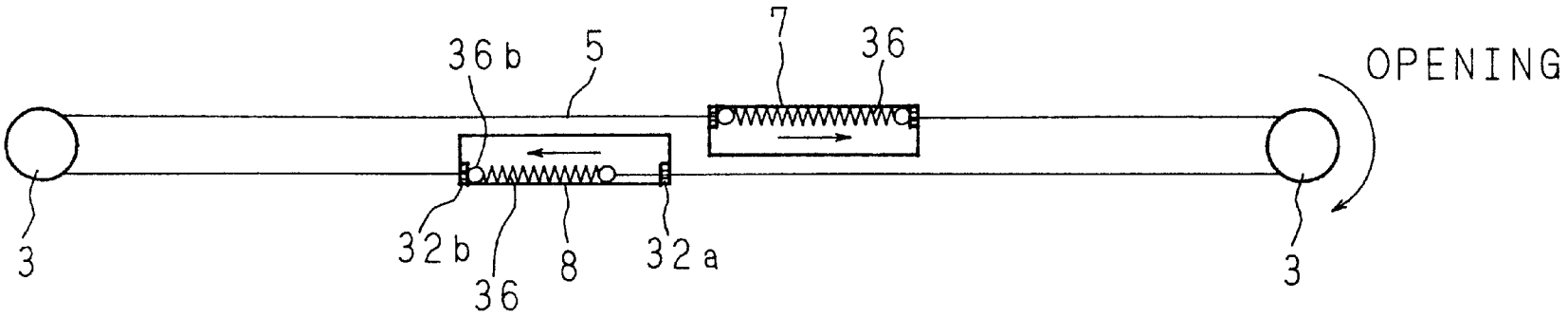
FIG. 16A and FIG. 16B, also referred to collectively as FIG. 16, are operation illustration showing the relationship between the leading runner and the loop-form string when the curtain according to embodiment 3 is opened or closed.
Figure 16B:
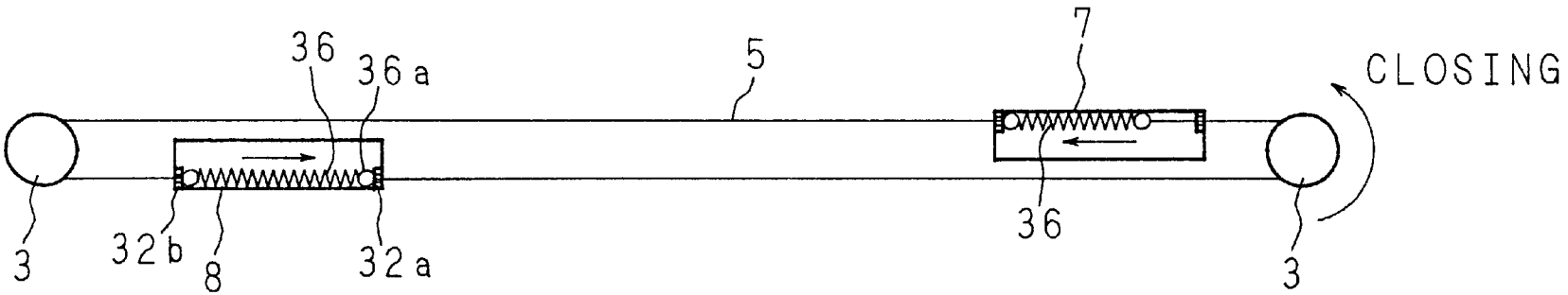

The operation of embodiment 3 as described above is discussed referring to the operation illustrations shown in FIG. 16A and FIG. 16B.

When the curtain K is in the stationary state, the coil spring 36 installed to each of the leading runners 7, 8, respectively, is located nearly at the center of both the stopper pieces 32*a*, 32*b* as shown in FIG. 15, and both the fixing rings 36*a*, 36*b* are held not in contact with the stopper pieces 32*a*, 32*b*.

Now, when the user pulls the curtain K in the opening direction with one curtain K held in hand while the curtain K is closed, the loop-form string 5 begins to be pulled in the arrow direction as shown in FIG. 16A, and at this moment, the loop-form string 5 is pulled on one side of the pulley 3 due to the rotation of the pulley 3, and is slightly slackened on the other side, and as a result, in the leading runners 7, 8, the coil spring 36 is extended, respectively, and the fixing ring 36*b* moves to the position where it collides against the stopper piece 32*b*, and at the position, it begins moving integrally with the leading runners 7, 8, and the curtains K on both sides then begin to be opened to right and left simultaneously.

On the other hand, when the curtain K is closed as shown in FIG. 16B, when pulling the curtain K in the closing direction with one curtain K held in hand, the loop-form string 5 is rotated by the revolution of the pulley 3, and is pulled on one side and is slightly slackened on the other side, and as a result, in the leading runners 7, 8, the coil spring 36 is extended, respectively, and the fixing ring 36*a* moves to the position where it collides against the stopper piece 32*a*, and at the position, it begins moving integrally with the leading runners 7, 8, and the curtains K on both sides then begin to be closed simultaneously.

That is, the moment the curtain K is pulled, the coil spring 36 stretches to alleviate impact applied to the loop-form string 5, and the life of the loop-form string 5 can be extended. In addition, while the curtains K are being closed or being opened, the loop-form string 5 has slack absorbed by the contraction force of the coil spring 36 and is held in a tension state.

Furthermore, because the loop-form string 5 itself is formed with a material such as wire, Kevler fiber, etc. with extremely small extensibility, slackness generated with time is little, and by properly establishing the extension and length of both coil springs 36 can prevent it from slackening over a long period of time and can maintain it to the tension state.

The guide rail body 1 is assembled in the plant by mounting the pulley 3 and the roller 6, laying the loop-form string 5 on the pulley 3, and slidably fitting the leading runners 7, 8 and freely moving runners 9 to the guide rail body 1, and has the pulleys 3 positioned to provide proper tension to the loop-form string 5, and the whole guide rail device is assembled for shipment.

Figure 17:
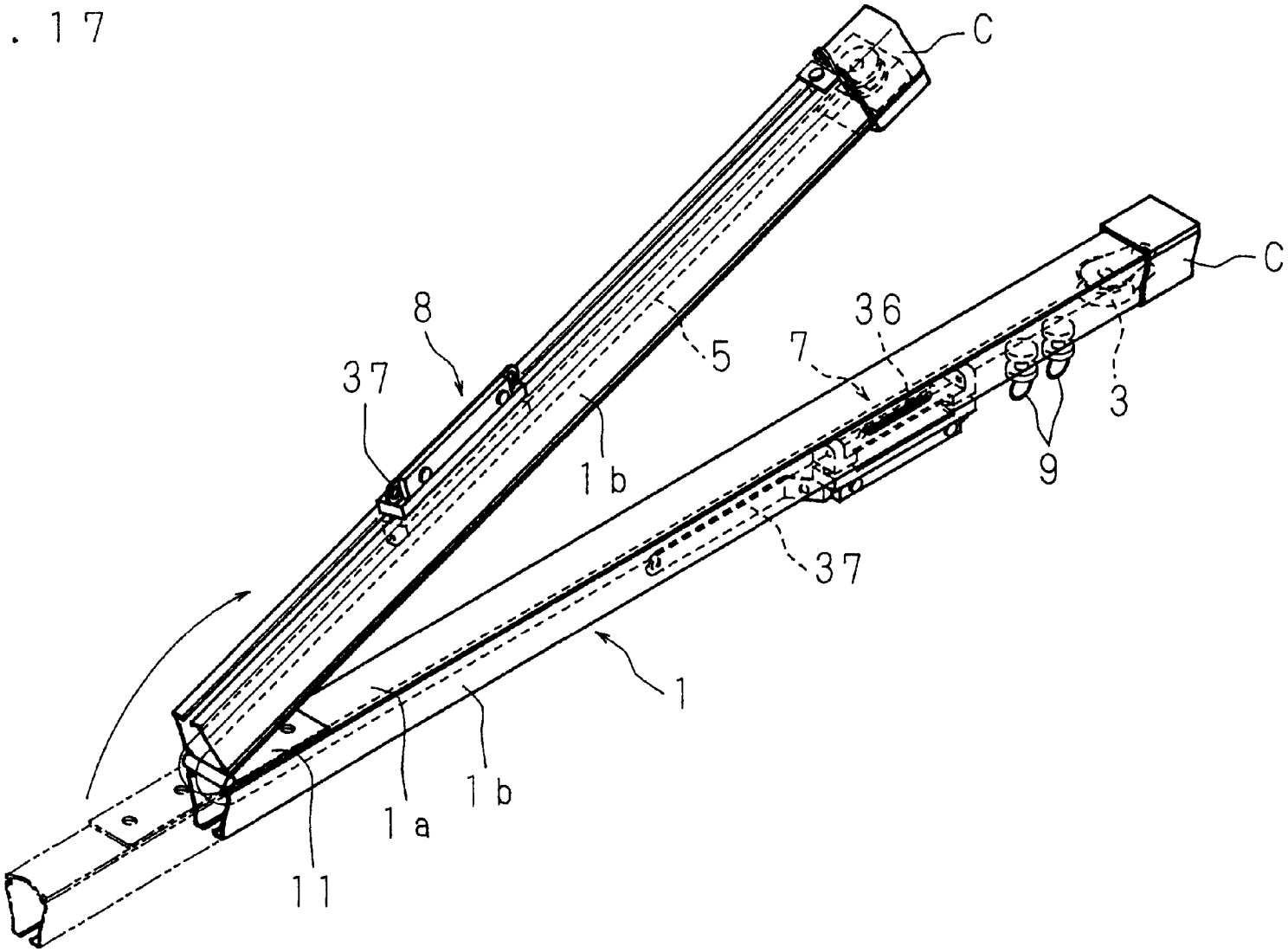
FIG. 17 is a perspective view showing the condition when the guide rail shown in FIG. 11 is folded.

At the time of shipment, the guide rail is bent into two portions at the hinge 11 as shown in FIG. 17, and packed in the shortened form into a carton or packaged for shipment. When the guide rail is bent into two portions, the loop-form string 5 is pulled more strongly, but to the loop-form string 5, the coil spring 36 which is an elastic member in the leading runners 7, 8, is linked, and by extension of this coil spring 36, the increased tension of the loop-form string 5 associated with the bending is alleviated, and it thereby becomes possible to prevent large tightening force from being exerted on the pulley 3. In addition, bulkiness of the guide rail can be reduced during transportation, and transportation cost can be reduced, and carrying the guide rail as it is to the installation site, unpacking, and extending the linkage portion by the hinge 11 as it is causes both end faces of the guide rail body 1 to butt each other to extend in a line, and enables immediate installation.

For connecting members, leather piece or soft synthetic resin plates or canvas, etc. may be used in place of the hinge 11. The thickness of these connecting members is desirable to be equivalent to or less than the wall thickness of the cap C in order to prevent any inconvenience in installation of the guide rail body 1.

Embodiment 4

Figure 18:
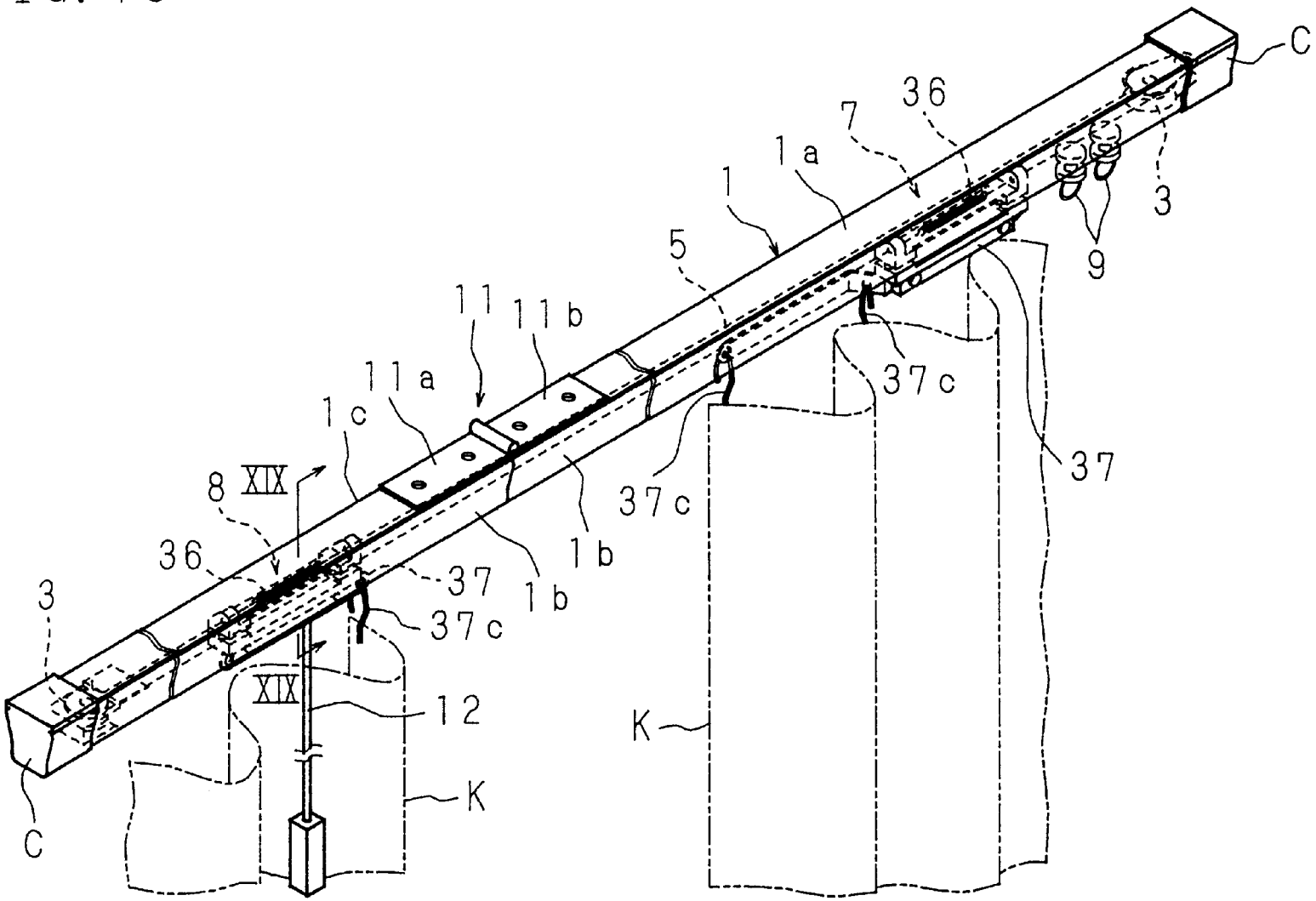
FIG. 18 is a perspective view showing the configuration of curtain guide rail according to embodiment 4.
Figure 19:
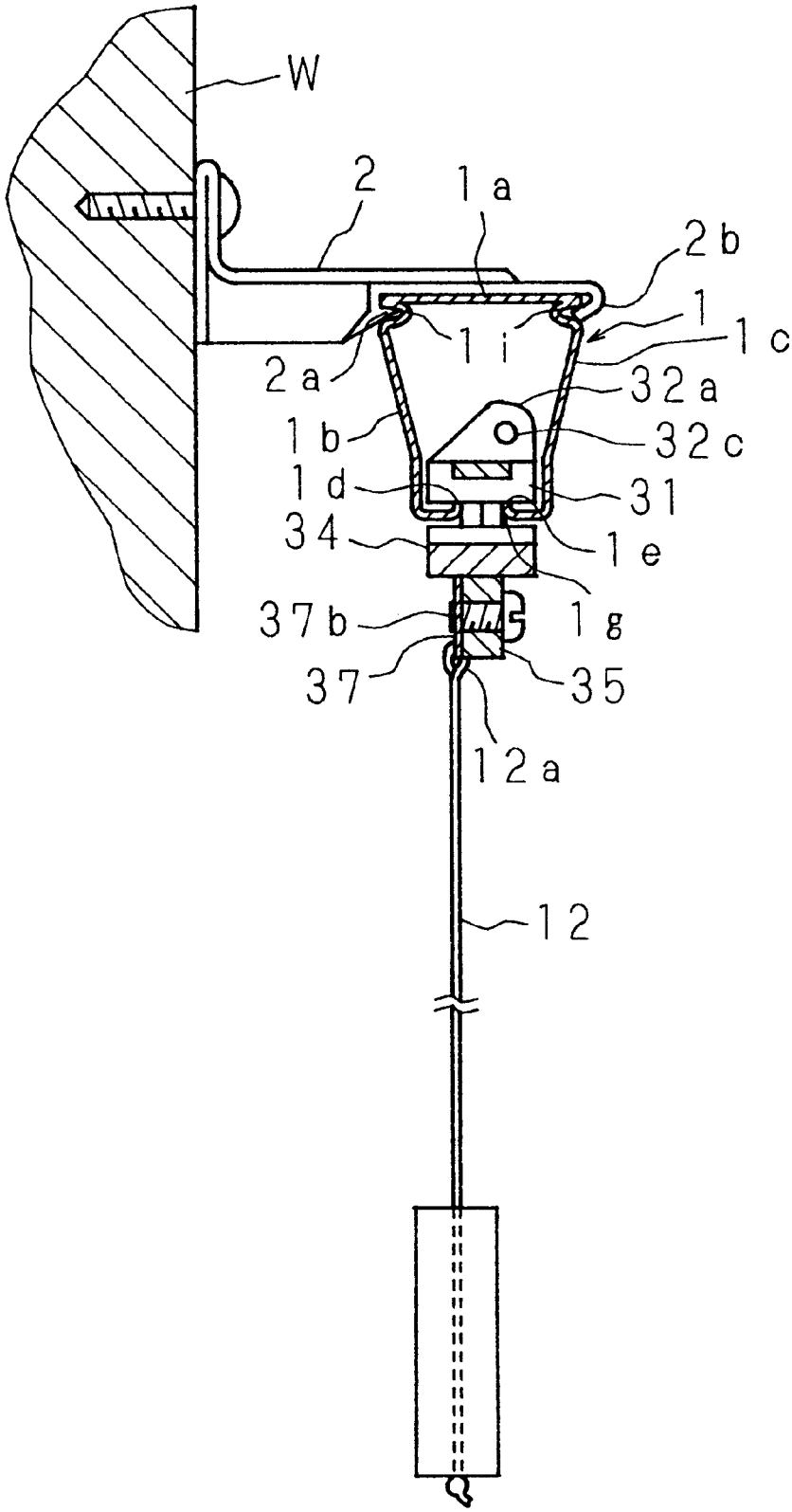
FIG. 19 is an enlarged cross-sectional view taken on line XIX—XIX of FIG. 18.

FIG. 18 is a perspective view showing the configuration of the guide rail for manually opened and closed type curtains according to embodiment 4, FIG. 19 an enlarged cross-sectional view taken on line XIX—XIX of FIG. 18. In the embodiment 4, to the hole of the hanger rod 37 of the curtain K in the leading runner 8, a hook 12*a* mounted to the head end of a string 12 is engaged and hung as it is. Other configurations are virtually same as that of Embodiment 3, and the same reference numbers are assigned to the corresponding portions and description is omitted.

In embodiment 4, in addition to the operations and effects achieved in embodiment 3, compared to the case in which the curtain K is opened and closed with the curtain K directly in hand, the curtain K is free of damage to the cloths, and it is possible to prevent stains from adhering to the curtain K.

In addition, when the curtain K is closed, the pulling string 12 is covered with the curtain K because the long extended head end portion of the hanger rod 37 of the leading runner 7 is located in front of the pulling string 12, and is hidden from the outside, providing good appearance.

Embodiment 5

Figure 20:
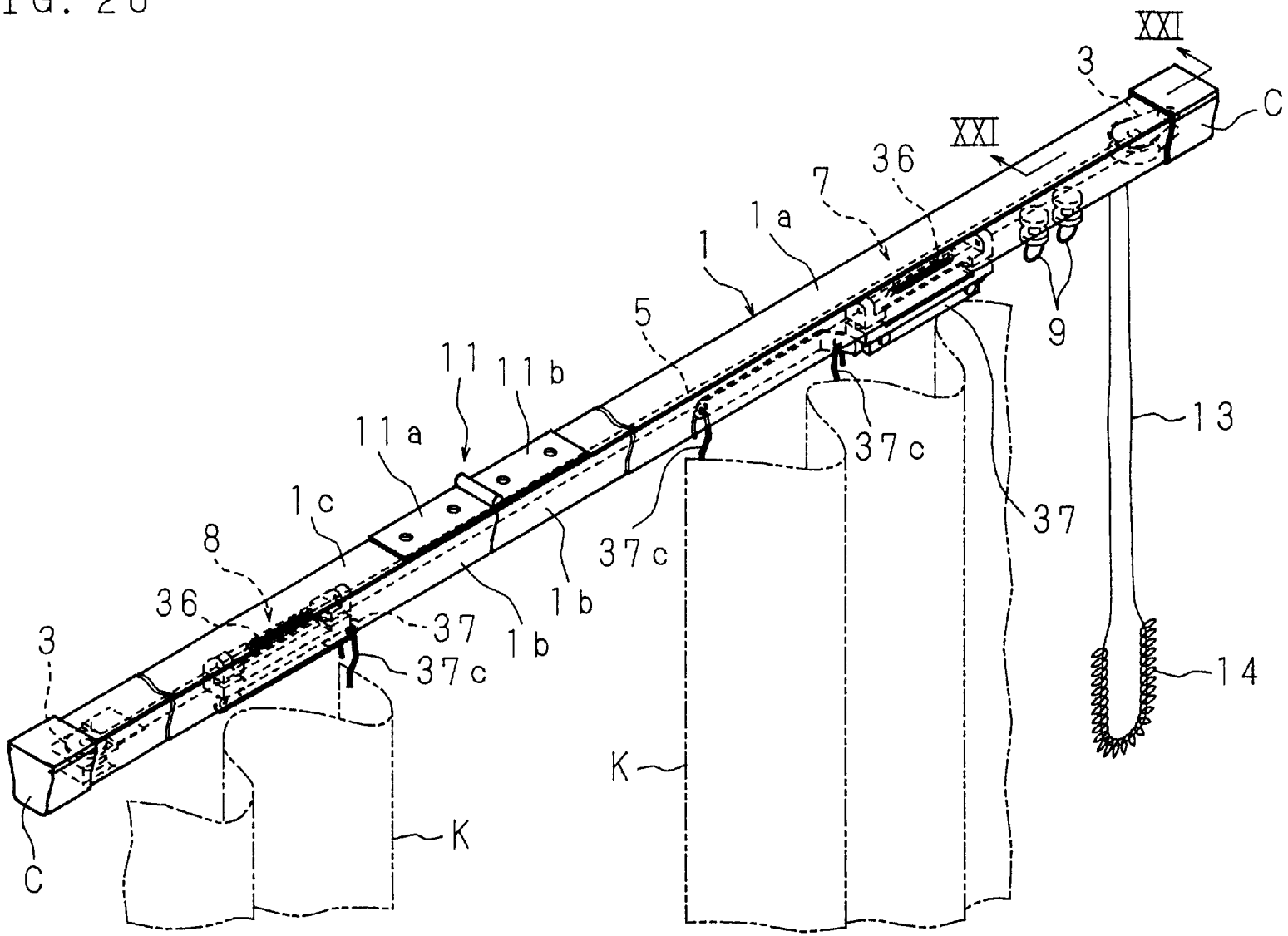
FIG. 20 is a perspective view showing the configuration of curtain guide rail according to embodiment 5.
Figure 21:
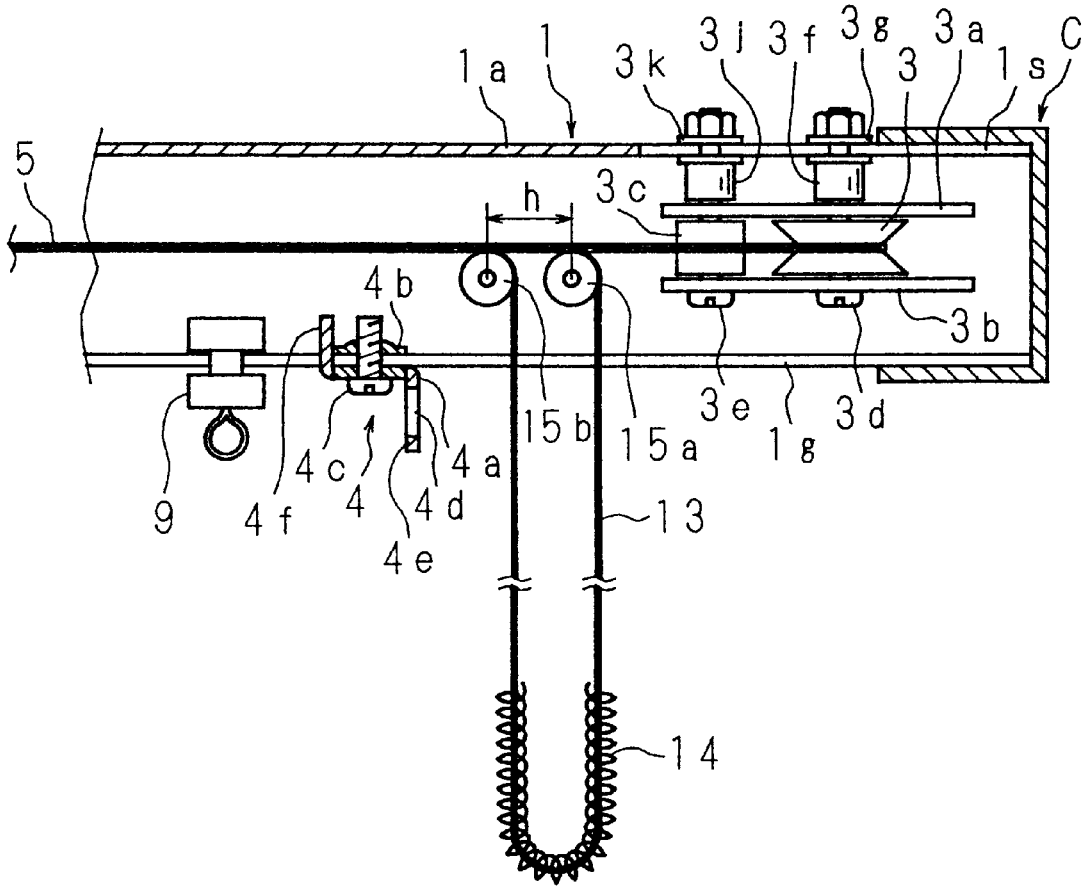
FIG. 21 is an enlarged cross-sectional view taken on line XXI—XXI of FIG. 20.
Figure 22:
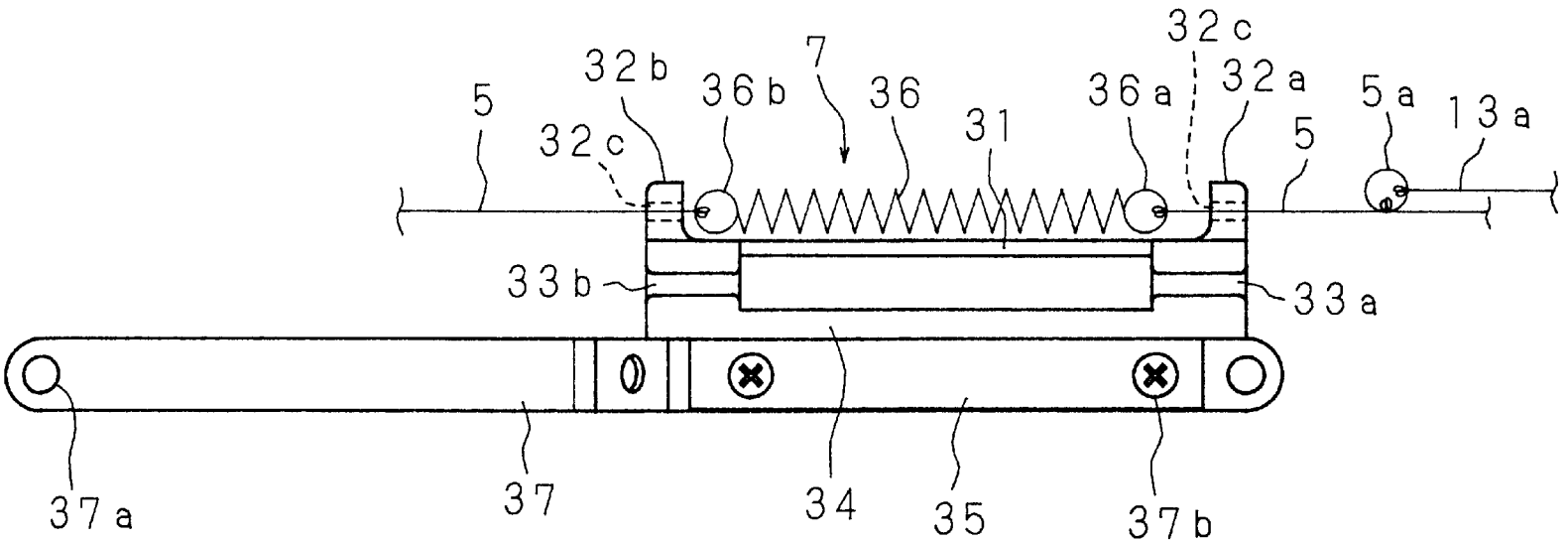
FIG. 22 is an enlarged front view of the leading runner of FIG. 20.
Figure 23A:
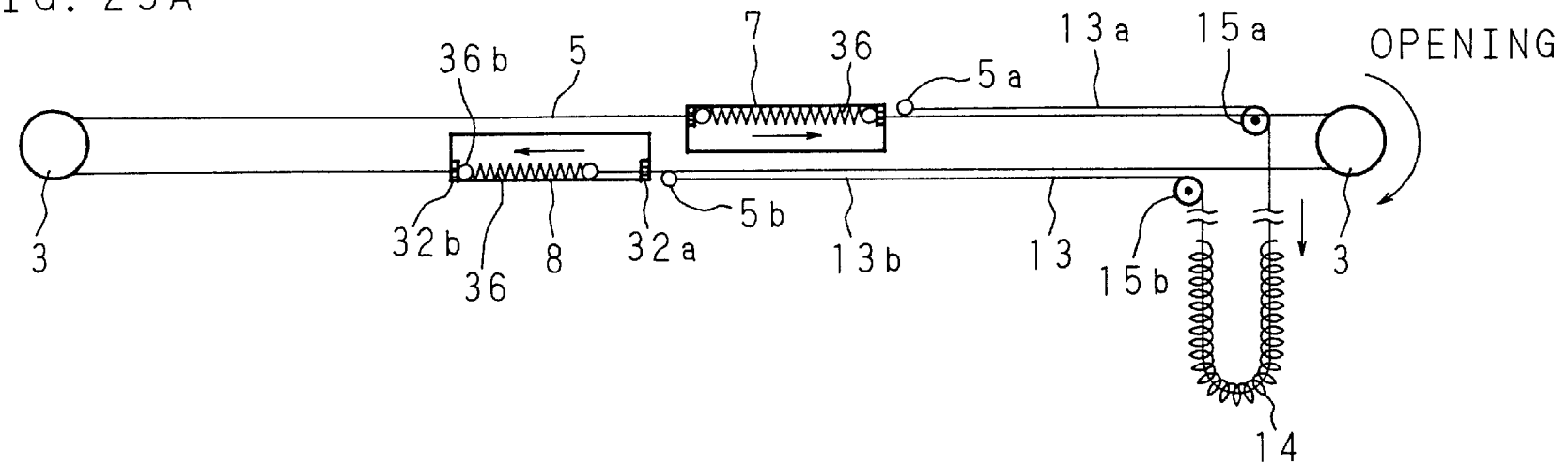
FIG. 23A and FIG. 23B, also referred to collectively as FIG. 23, are operation illustrations showing the relationship between the leading runner, loop-form string, and operating string when the curtain according to embodiment 5 is opened and closed.
Figure 23B:
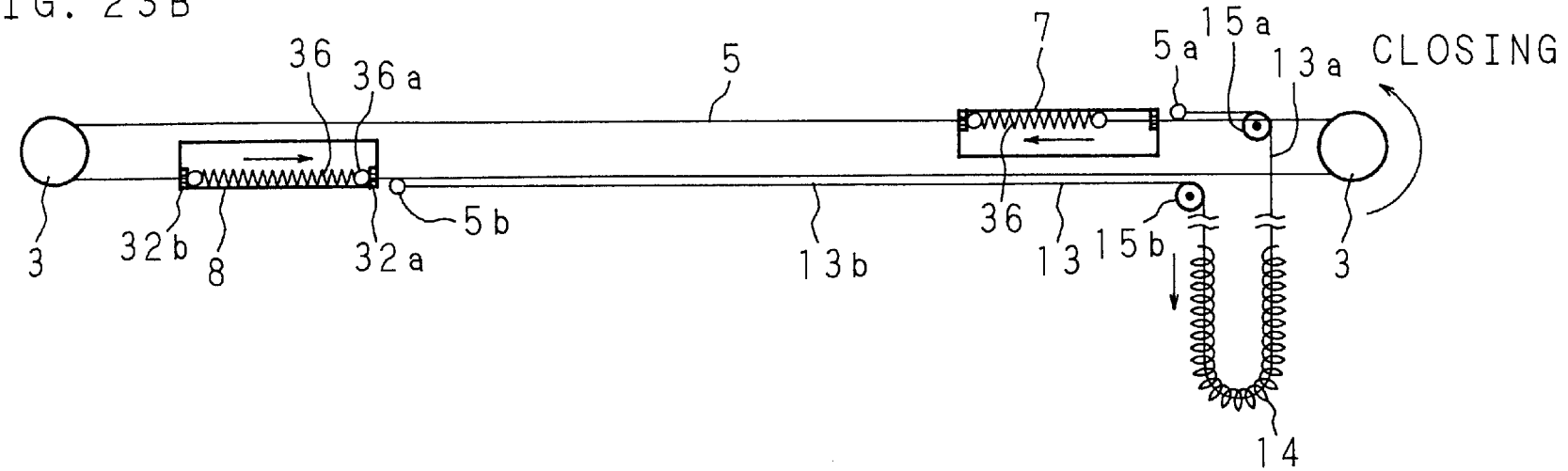

FIG. 20 is a perspective view showing a configuration of a guide rail for manually opened and closed type curtains according to Embodiment 5, FIG. 21 an enlarged cross-sectional view taken on line XXI—XXI of FIG. 20, FIG. 22 an enlarged front view of a leading runner, FIG. 23A and FIG. 23B operation illustrations showing the relationship between the leading runner, a loop-form string, and an operating string when the curtain K is opened or closed, respectively, and numeral 13 in the figure designates an operating string. The operating string 13 comprises, for example, a braided rope, etc., through which a coil spring 14 is passed, one end portion 13*a* of the operating string 13 is introduced from a guide groove 1*g* of the guide rail body 1 into the guide rail body 1, and extended near the leading runner 7 via a guide roller 15*a* as shown in FIG. 22, and bound to a knot 5*a* formed on the loop-form string 5. The other end portion 13*b* of the operating string 13 is similarly introduced from the guide groove 1*g* of the guide rail body 1 into the guide rail body 1, and extended near the leading runner 8 via a guide roller 15*b* as shown in FIG. 23A and FIG. 23B, and bound to a knot 5*b* formed on the loop-form string 5.

The guide rollers 15*a*, 15*b* are part of the guide rail body 1, and are pivoted in parallel to the side plates 1*b*, 1*c* between a stopper 4 and a pulley 3 with a distance h apart in the longitudinal direction of the guide rail body 1 in such a manner that the operating string 13 is located at the nearly same height to the stretched height of the loop-form string 5 hung to the pulley 3.

The coil spring 14 is intended to be relatively movable by dead weight with respect to the operating string 13, and when one side of the operating string 13 is pulled to open or close the curtain K, the other side moves to ascend with the operation, but the coil spring 14 moves relative to the operating string 13 by dead weight and is constantly located at the lowermost end portion, and intended to provide proper tension constantly to the operating string 13.

When a wood or metal doughnut-shaped members are passed through the operating string 13 in place of the coil spring 14, these come in contact with the curtain K and prevent the operating string 13 from twisting, producing the same effects.

In embodiment 5 as described above, in addition to the operations and effects achieved with embodiment 3, pulling one of the operating string 13 on one side of the window can move the curtain K to open simultaneously and pulling the other can move it to close simultaneously. In addition, if the hand is released from the operating string 13 when the opening and closing operations are finished, the operating string is held to a tension state by the gravity of the coil spring 14, solving the problem of ugly appearance, etc. in which the operating string 13 is slackened and hang downwards from the guide groove Ig of the guide rail body 1.

In addition, because the operating string 13 is guided out in parallel downwards of the guide rail body 1 by suspending it over the guide rollers 15*a*, 15*b* pivoted in parallel to one end portion of the guide rail body 1, the operating string is always maintained in parallel to the user standing opposite to the curtain K together with contraction of the coil spring 14, and inconveniences can be solved, for example, in that the strings on both sides are twisted and it is unable to identify which string to be pulled, and the twist must be corrected each time to pull the string.

Other construction and operation as well as effects are virtually same as those of embodiment 3, and like reference numbers are given to corresponding portions and the explanation is omitted.

In embodiment 3 to embodiment 5 as described above, construction with the guide rail body 1 for curtains divided into two portions is shown, but needless to say, it may be divided in a plurality of portions.

In embodiment 3 to embodiment 5, cases when the invention is applied to guide rails for window curtains are shown, but needless to say, the invention can be applied to, for example, guide rails for theater curtains, curved guide rails, etc.

In addition, for the weight, doughnut shape is preferable from the viewpoint of interiors, but coil springs may be colored in the same color as that of the operating string 13 to make it inconspicuous.

In embodiment 3 to embodiment 5, because a loop-form string is laid over pulleys pivoted to both end portions of the guide rail body and the leading runners are slidably fitted to the guide rail body, and each of these leading runners is linked to the loop-form string, pulling either one of the curtains linked to the leading runner by either one directly held in hand can open and close both curtains simultaneously.

In embodiment 3 to embodiment 5, operating the operating string or button equipped either one of the leading runners can open and close simultaneously right and left curtains.

In embodiment 3 to embodiment 5, because the guide rail body is bendably linked to the hinge, the long guide rail body can be easily carried and handled.

In embodiment 3 to embodiment 5, because the elastic member is intermediately installed at the connections between the leading runner and the loop-form string, the loop-form string can be constantly maintained to the tension state.

In embodiment 5, because an overlapping portion that can be moved relative to the operating string is provided at the end portion of the operating string pulled from the end portion of the guide rail body to the outside, the operating string can be maintained to the tension state and inconvenience in teat the operating string hangs downwards from the guide rail body can be prevented, and because the operating string is located hung in parallel from the guide rail body, inconvenience in which the user is unable to identify which side should be pulled as the operating string is twisted when the user is located opposite to the curtain, and the user must correct the twist each time and pull the operating string is prevented.

In embodiment 3 to embodiment 5, the long guide rail body 1 can be folded at one or a plurality of places, and can be easily transported and handled free of bulkiness.

In embodiment 3 to embodiment 5, because the elastic member is intermediately installed at the connections between the leading runner and the loop-form string, slackness is not generated and tension state can be maintained.

In embodiment 5, because the operating string an the loop-form string are linked by making knots in the loop-form string, to which the end portion of the operating string is bound or is linked via a hook, it is no need to provide special processing to the leading runner, achieving another advantage of easy assembly.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A curtain operating system comprising;

a leading runner and a line adapted to open and close at least one curtain as and close the curtains while the line is tensioned in the form of a loop, the leading runner including:

a pair of stopper members oppositely disposed with a predetermined clearance provided along an axis in a moving direction of the line; and an elastic member having opposing end portions, said elastic member being located between the stopper members and being moveable therebetween so as to have its movement limited by contact with the stopper members, said elastic member being held in an extended state and linking one end of the end portions to one end of the line and the other end portion to the other end of the line.

2. The curtain operating system of claim 1 further comprising a guide rail for electrically opened and closed type curtains for supporting and guiding the curtains in the moving direction, the guide rail including a motor and a pulley disposed at one end portion of the guide rail and further comprising:

a winch disposed at the other end portion of the guide rail and attached to the motor;

the line for opening and closing the curtain laid between the pulley and the winch;

the leading runner being intermediately linked to part of the line, movably placed between the pulley and the winch, and being adapted to support the top end portion of the curtain, the line being wound around the winch by a plurality of turns.

3. The curtain operating system of claim 1 further comprising a guide rail for curtains for supporting and guiding the curtains in the moving direction, the guide rail comprising;

a guide rail body divided at a plurality of places in the longitudinal direction and, defining a plurality of guide rail segments; and bendable couplers linking end portions of the guide rail segments in a series.

4. A curtain operating system according to claim 3 wherein the bendable couplers are selected from the group comprising hinges, leather pieces, synthetic resin pieces, or textile pieces.

5. The curtain operating system of claim 3, further comprising.

a motor;

a pulley disposed at one end portion of the guide rail body;

a winch disposed at the other end portion of the guide rail body and attached to the motor;

the line for opening and closing the curtain laid between the pulley and the winch; and the leading runner being intermediately linked to part of the line, movably placed between the pulley and the winch, and supporting the top end portion of the curtain.

6. A curtain operating system according to claim 5, wherein the bendable couplers are selected from the group comprising hinges, leather pieces, synthetic resin pieces, or textile pieces.

7. The curtain operating system of claim 1, further comprising a guide rail for supporting and guiding manually opened and closed type curtains in the moving direction, comprising;

a guide rail body with the cross section of inverted U-letter form;

pulleys pivoted to both end portions of the guide rail body, respectively;

the line in the form of the loop laid between both the pulleys, and the leading runner and at least one free-moving runner slidably fitted to the guide rail body, intermediately linked to part of the loop-form line.

8. A curtain operating system according to claim 7, wherein the operating string or button is mounted to either one of the pair of leading runners.

9. A curtain operating system according to claim 7 wherein the guide rail body is divided at a plurality of places in the longitudinal direction, defining a plurality of guide rail segments;

further comprising bendable couplers which link end portions of the guide rail segments in series.

10. Curtain operating system of claim 1, further comprising a guide rail for manually opened and closed curtains for supporting and guiding the curtains in the moving direction, comprising:

a guide rail body with a cross section of inverted U-letter form;

pulleys pivoted to both end portions of the guide rail body, respectively;

the line in a form of loop laid between both the pulleys; and the leading runner being adapted to support the head end portion of the curtain, which is slidably fitted to the guide rail body and being movably placed between the pulleys by being intermediately linked to part of the line, an operating string linked to the line loop adjacent the leading runner and with an intermediate portion of the operating string extending out from one end portion of the guide rail body to the outside;

a weight attached relatively movable to the operating string.

11. A curtain operating system according to claim 10, wherein the guide rail body is divided at a plurality of places in the longitudinal direction, defining a plurality of guide rail segments, further comprising bendable couplers which link the end portions of the guide rail segments in series.

12. A curtain operating system according to claim 10, wherein the line forms a knot, and the operating string has an end portion bound to the knot.

13. A curtain operating system according to claim 10, wherein the line forms a knot, and the operating string is equipped with a hook, and the hook is engaged to the knot.

14. A curtain operating system for supporting and guiding manually opened and closed curtains in the moving direction, comprising:

pulleys disposed at both end portions of the guide rail, respectively;

a line for opening and closing the curtains laid between the pulleys and tensioned in a form of a loop; and a leading runner intermediately linked to part of the line and movably placed between the pulleys, and adapted to support the top end portion of the curtain, wherein the leading runner includes;

a pair of stopper members oppositely disposed with a predetermined clearance provided along an axis in a moving direction of the leading runner; and an elastic member having opposing end portions, said elastic member being located between the stopper members and being moveable therebetween so as to have its movement limited by contact with the stopper members, said elastic member being held in an extended state and linking one end of the end portions to one end of the line and the other end portion to the other end of the line.

* * * * *

UNITED STATES PATENT AND TRADEMARK OFFICE

CERTIFICATE OF CORRECTION

PATENT NO. : 6,085,826

DATED : July 11, 2000

INVENTOR(S) : Shu MAESAKI

It is certified that error appears in the above-indentified patent and that said Letters Patent is hereby corrected as shown below:

Foremost page, [76] Inventor: please correct the name of the inventor's address from "Higashiosaka, Japan" to read:

-- Shu MAESAKI, Osaki, Japan --

Signed and Sealed this

Seventeenth Day of April, 2001

*Attest:*

Nicholas P. Godici

NICHOLAS P. GODICI

*Attesting Officer*

*Acting Director of the United States Patent and Trademark Office*